US010269521B2

(12) United States Patent
Pan et al.

(10) Patent No.: US 10,269,521 B2
(45) Date of Patent: Apr. 23, 2019

(54) MOUNTING STRUCTURE FOR ENERGY STORAGE ASSEMBLY OF CIRCUIT BREAKER

(71) Applicants: ZHEJIANG CHINT ELECTRICS CO., LTD., Zhejiang (CN); SEARI ELECTRIC TECHNOLOGY CO., LTD., Shanghai (CN)

(72) Inventors: Binhua Pan, Zhejiang (CN); Jisheng Sun, Shanghai (CN)

(73) Assignees: ZHEJIANG CHINT ELECTRICS CO., LTD (CN); SEARI ELECTRIC TECHNOLOGY CO., LTD. (CN)

( * ) Notice: Subject to any disclaimer, the term of this patent is extended or adjusted under 35 U.S.C. 154(b) by 0 days.

(21) Appl. No.: 15/750,222

(22) PCT Filed: Aug. 2, 2016

(86) PCT No.: PCT/CN2016/092930
§ 371 (c)(1),
(2) Date: Feb. 5, 2018

(87) PCT Pub. No.: WO2017/020818
PCT Pub. Date: Feb. 9, 2017

(65) Prior Publication Data

US 2018/0240633 A1 Aug. 23, 2018

(30) Foreign Application Priority Data

Aug. 4, 2015 (CN) ..... 2015 1 0470897
Aug. 4, 2015 (CN) ..... 2015 1 0471070

(51) Int. Cl.
*H01H 3/30* (2006.01)
*H01H 71/02* (2006.01)
(Continued)

(52) U.S. Cl.
CPC ..... *H01H 71/0264* (2013.01); *H01H 3/30* (2013.01); *H01H 3/38* (2013.01);
(Continued)

(58) Field of Classification Search
CPC ..... H01H 3/38; H01H 71/0264; H01H 3/30; H01H 5/04; H01H 9/20; H01H 71/10
(Continued)

(56) References Cited

FOREIGN PATENT DOCUMENTS

CN 201556540 * 8/2010 ..... H01H 3/30
CN 201556540 U 8/2010
(Continued)

OTHER PUBLICATIONS

International Search Report dated Oct. 25, 2016 in corresponding PCT International Application No. PCT/CN2016/092930.
(Continued)

*Primary Examiner* — Renee S Luebke
*Assistant Examiner* — Iman Malakooti
(74) *Attorney, Agent, or Firm* — Ostrolenk Faber LLP

(57) ABSTRACT

A mounting structure for an energy storage assembly of a circuit breaker comprises an energy storage lever and an energy storage spring, wherein one end of the energy storage lever is an energy storage end which is connected with the energy storage spring, and the other end of the energy storage lever is a driving end. An external force can be applied to the driving end, such that the energy storage lever rotates around a lever fulcrum in the middle of the energy storage lever, thereby extruding the energy storage spring at the energy storage end to finish energy storage. One end of the energy storage spring is connected and mounted with the energy storage lever, and the other end of the energy storage spring is mounted in a base support. An energy storage mounting shaft which can be considered as a rotating fulcrum is also arranged in the middle of the energy storage
(Continued)

lever. The driving end is stressed, such that the energy storage lever rotates around the energy storage mounting shaft. The mounting structure for the energy storage assembly of the circuit breaker, which is provided by the present invention, is simple in mounting process, stable in connection structure and high in assembly accuracy.

13 Claims, 11 Drawing Sheets

(51) Int. Cl.

| | |
|---|---|
| ***H01H 3/38*** | (2006.01) |
| ***H01H 5/04*** | (2006.01) |
| ***H01H 9/20*** | (2006.01) |
| ***H01H 71/10*** | (2006.01) |
| ***H01H 71/12*** | (2006.01) |
| *H01H 71/50* | (2006.01) |
| *H01H 71/52* | (2006.01) |

(52) U.S. Cl.
CPC ..... *H01H 5/04* (2013.01); *H01H 9/20* (2013.01); *H01H 71/1009* (2013.01); *H01H 71/128* (2013.01); *H01H 3/3015* (2013.01); *H01H 3/3026* (2013.01); *H01H 71/505* (2013.01); *H01H 71/525* (2013.01); *H01H 2003/3068* (2013.01); *H01H 2003/3073* (2013.01)

(58) Field of Classification Search
USPC ..... 200/237
See application file for complete search history.

(56) References Cited

FOREIGN PATENT DOCUMENTS

| | | | | |
|---|---|---|---|---|
| CN | 202076198 | * | 12/2011 | ..... H01H 71/10 |
| CN | 202076198 U | | 12/2011 | |
| CN | 102522232 A | | 6/2012 | |
| CN | 103646827 A | | 3/2014 | |
| CN | 204375676 U | | 6/2015 | |
| EP | 1 164 605 A2 | | 12/2001 | |

OTHER PUBLICATIONS

Written Opinion dated Oct. 25, 2016 in corresponding PCT International Application No. PCT/CN2016/092930.

* cited by examiner

MOUNTING STRUCTURE FOR ENERGY STORAGE ASSEMBLY OF CIRCUIT BREAKER

CROSS-REFERENCE TO RELATED APPLICATIONS

The present application is a 35 U.S.C. §§ 371 national phase conversion of PCT/CN2016/092930, filed Aug. 2, 2016, which claims priority to Chinese Patent Application Nos. 201510470897.9 and 201510471070.X, both filed Aug. 4, 2015, the contents of which are incorporated herein by reference. The PCT International Application was published in the Chinese language.

TECHNICAL FIELD

The present invention relates to the field of low-voltage apparatuses, and more particularly to a mounting structure for an energy storage assembly of a circuit breaker.

BACKGROUND ART

At present, an operation mechanism of a molded case circuit breaker is usually of a manual pick-and-push type, and if a user requires an electric operation, an external electric operation attachment is often provided to be mounted outside the circuit breaker to electrically and remotely control the function of the circuit breaker. However, for a high-capacity molded case circuit breaker, the external operation mechanism attachment tends to have a larger volume and weight, and thus have higher requirements for the mounting quality. In particular, when the operation mechanism cooperates with a circuit breaker body, the substantial impact vibration easily causes failure of key parts such as a circuit breaker housing and a locking device. Therefore, the external operation mechanism attachment of the existing molded case circuit breaker has huge volume, heavy weight and poor reliability. In addition, the previous energy pre-storage operation mechanism is only used on an air circuit breaker, and cannot be applied to the molded case circuit breaker and interchanged with the existing manual pick-and-push type operation mechanism to meet different market needs. Therefore, it is urge to need a novel energy pre-storage operation mechanism built in the circuit breaker to realize intelligent control of the circuit breaker. The operation mechanism has the same mounting way and tripping position as the manual pick-and-push type operation mechanism, realizes the interchange with the manual pick-and-push type operation mechanism, meets the needs of different users, and is capable of overcoming the defects of huge volume, heavy weight, high cost and poor reliability of the manual pick-and-push operation mechanism because the circuit breaker is equipped with an external electric operation attachment.

SUMMARY OF THE INVENTION

An objective of the present invention is to overcome the defects of the prior art and provide a mounting structure for an energy storage assembly of a circuit breaker, which is simple in mounting process, stable in connecting structure and high in assembly accuracy.

To fulfill said objective, the present invention adopts the following technical solution.

A mounting structure for an energy storage assembly of a circuit breaker comprises an energy storage lever 42 and an energy storage spring 48, wherein one end of the energy storage lever 42 is an energy storage end which is connected with the energy storage spring 48, and the other end of the energy storage lever 42 is a driving end. An external force may be applied to the driving end, such that the energy storage lever 42 rotates around a lever fulcrum in the middle of the energy storage lever 42, thereby extruding the energy storage spring 48 at the energy storage end to finish energy storage. One end of the energy storage spring 48 is connected and mounted with the energy storage lever 42, and the other end of the energy storage spring 48 is mounted in a base support 46. An energy storage mounting shaft 41 which may be considered as a rotating fulcrum is also arranged in the middle of the energy storage lever 42. The driving end is stressed, such that the energy storage lever 42 rotates around the energy storage mounting shaft 41.

Further, the base support 46 is of a U-shaped structure. The side surface of the base support 46 having the U-shaped structure may be connected and mounted with a side plate assembly 1 configured to fix, thereby fixing the energy storage spring 48 inside the base support 46. The base support 46 having the U-shaped structure comprises a base supporting sheet 461 which may be connected with the end part of the energy storage spring 48. Base mounting sheets 47 are oppositely arranged at two sides of the base supporting sheet 461. Each base mounting sheet 47 is provided with a support mounting hole 473 which may be matched and connected with the side plate assembly 1 through a support positioning pin 14.

Further, a support guide rail 471 configured to guide and limit is also arranged on the base mounting sheet 47. A guiding shaft 13 is fixedly mounted on the side plate assembly 1.

Further, the support guide rail 471 is arranged at the end part of the base mounting sheet 47. During mounting, when the guiding shaft 13 on the side plate assembly 1 is in contact with a guide rail tail end 472, a support hole 473 and a positioning pin fixing hole 111 in the side plate assembly 1 are aligned and mounted via the support positioning pin 14 in a connecting manner.

Further, the side plate assembly 1 comprises a first side plate 11 and a second side plate 12. The energy storage assembly of the circuit breaker is mounted between the first side plate 11 and the second side plate 12. The base mounting sheets 47 at two sides o the base support 46 may be in contact and connection with the first side plate 11 and the second side plate 12 respectively, and the base supporting sheet 461 of the base support 46 is located at one side of the side plate assembly 1, which is connected to the circuit breaker, and is mounted to one end of the side plate assembly 1. The base mounting sheets 47 at two sides of the base support 46 are flush with the side edge at one end of the first side plate 11 and the side edge at one end of the second side plate 12.

Further, the energy storage lever 42 comprises at least two energy storage mounting sheets 421 which are arranged side by side. The energy storage mounting shaft 41 penetrates through the energy storage lever 42 and may be rotatably connected with each energy storage mounting sheet 421 in a hole-shaft manner.

Further, a rotatable driving shaft 30 is arranged at one side of the energy storage lever 42. A connecting rod assembly 2 and a cam assembly 3 are mounted on the driving shaft 30. The cam assembly 3 may be in contact and connection with a driving end of the energy storage lever 42, such that the energy storage assembly stores energy. The connecting rod assembly 2 may be in contact and connection with the energy storage lever 42 and may also be connected with a rotating shaft assembly 5 for driving a switching-on/switching-off operation. In a switching-on process, the energy storage assembly releases energy, the energy storage lever 42 hits the connecting rod assembly 2 to enable the end part thereof to pull the rotating shaft 5, thereby finishing the switching-on operation. In addition, in the switching-on/switching-off process, the connecting rod assembly 2 and the cam assembly 3 are kept to move at one side of the energy storage lever 42.

Further, the cam assembly 3 may be driven by the driving shaft 30 to enable a cam 33 to jack a driving end of the energy storage lever 42, such that the energy storage lever 42 rotates to compress the energy storage spring 48 to finish energy storage. In addition, in an energy release process, a movement direction of the driving end of the energy storage lever 42 is opposite to that of the cam 33.

Further, the energy storage assembly is mounted on the side plate assembly 1. The side plate assembly 1 comprises a first side plate 11 and a second side plate 12 which face each other. Two ends of the energy storage mounting shaft 41 are fixedly mounted on the first side plate 11 and the second side plate 12 respectively. One end of the energy storage spring 48 is mounted to one side of the side plate assembly 1, which is connected with the circuit breaker, through the base support 46. The energy storage lever 42 and the base support 46 face each other. The energy storage lever 42 and the energy storage spring 48 are of an L shape and arranged at one side of the side plate assembly 1 away from the circuit breaker. Two ends of the rotating shaft assembly 5 and two ends of the driving shaft 30 are mounted on the first side plate 11 and the second side plate 12 respectively. The connecting rod assembly 2 and the cam assembly 3 are mounted on the driving shaft 30 and located below the energy storage lever 42. The rotating shaft assembly 5 is arranged between the energy storage spring 48 and the driving shaft 30. One end of the connecting rod assembly 2 is connected with the rotating shaft assembly 5, and the other end of the connecting rod assembly 2 is also connected with the control assembly 6 for controlling the switching-on/switching-off operation. The driving shaft 30 is arranged between the rotating shaft assembly 5 and the control assembly 6.

Further, the energy storage lever 42 is lower than the edges of the first side plate 11 and the second side plate 12.

Further, a main tension spring 49 for driving the rotating shaft assembly 5 to reset is arranged between the rotating shaft assembly 5 and the energy storage mounting shaft 41.

Further, the energy storage lever 42 comprises two energy storage mounting sheets 421 which are arranged side by side, and one energy storage mounting shaft 41, wherein the energy storage mounting shaft 41 penetrates through the two energy storage mounting sheets 421 respectively, and two ends of the energy storage mounting shaft 41 are fixed on the side plate assembly 1. The connecting rod assembly 2 and the cam assembly 3 are also arranged in the side plate assembly 1. A hitting pin 44 which may be in contact and connection with the connecting rod assembly 2 is arranged between the two energy storage mounting sheets 421. An energy storage bearing 43 which may be in contact and connection with the cam of the cam assembly 3 is also arranged at the end part of each energy storage mounting sheet 421.

Further, each energy storage mounting sheet 421 is arc-shaped, and two ends thereof are bent towards one side respectively, with one end being provided with the energy storage bearing 43 and the other end being connected with the energy storage spring 48 via a spring connecting sheet. The energy storage mounting shaft 41 is arranged in the middle of the energy storage mounting sheet 421, the hitting pin 44 is arranged between the energy storage mounting shaft 41 and the energy storage bearing 43, and the section of the hitting pin 44 is kidney-shaped.

Further, the support mounting hole 473 is of an oval structure. The surface of the support positioning pin 14 is provided with a clamping groove 141 and passes through the positioning pin fixing hole 111 and the support mounting hole 473 in sequence, and a retainer ring is clamped to the clamping groove 141.

By means of the base support, the mounting structure for the energy storage assembly of the circuit breaker of the present invention realizes simple mounting of the energy storage spring, improves the assembly efficiency of the energy storage assembly, facilitates maintenance and replacement of the energy storage assembly at the same time, and improves the practicability of the device. Moreover, the energy storage mounting shaft in the middle of the energy storage lever improves the rotating flexibility and stability of the energy storage lever.

DETAILED DESCRIPTION

Specific embodiments of a mounting structure for an energy storage assembly of the circuit breaker of the present invention will be further described below with reference to the examples of the present invention provided by FIGS. 1 to 31. The mounting structure for the energy storage assembly of the circuit breaker of the present invention is not limited to the description of the following examples.

Figure 1:
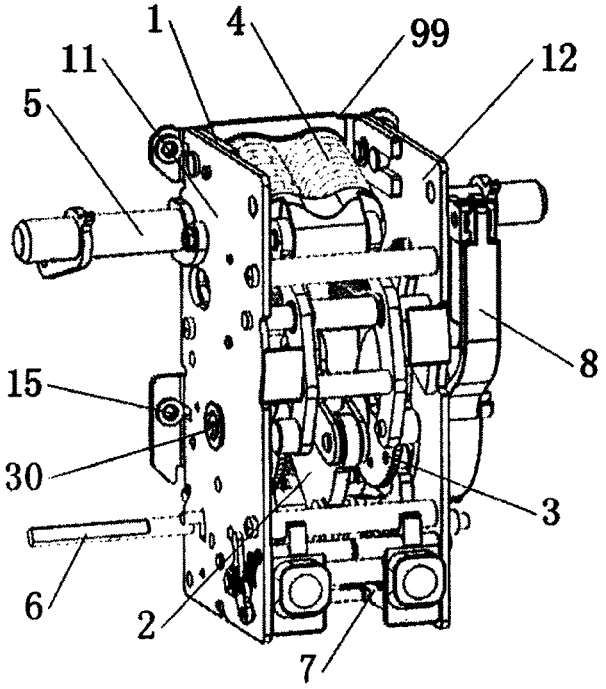
FIG. 1 is a schematic structural drawing of the present invention.
Figure 2:
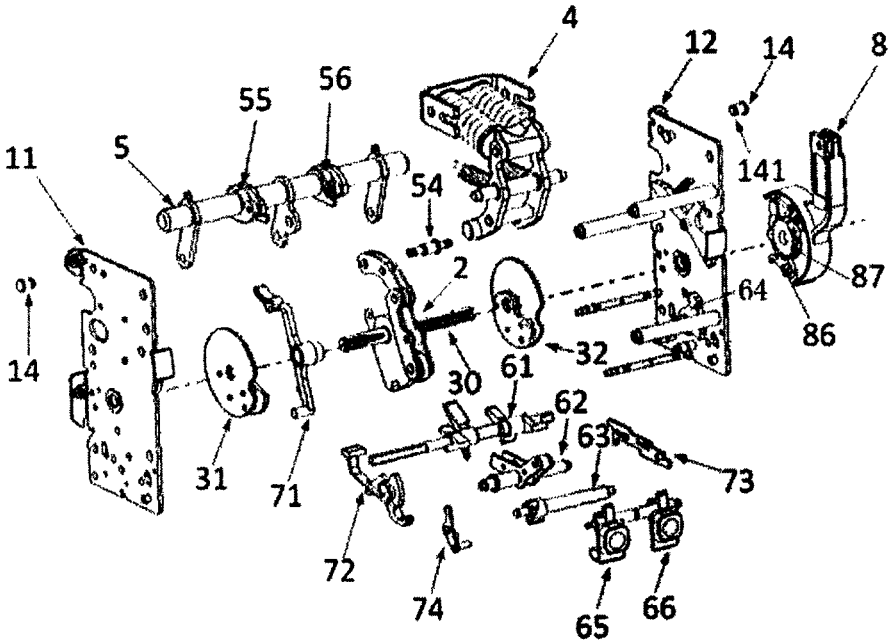
FIG. 2 is an exploded structural drawing of the present invention.
Figure 3:
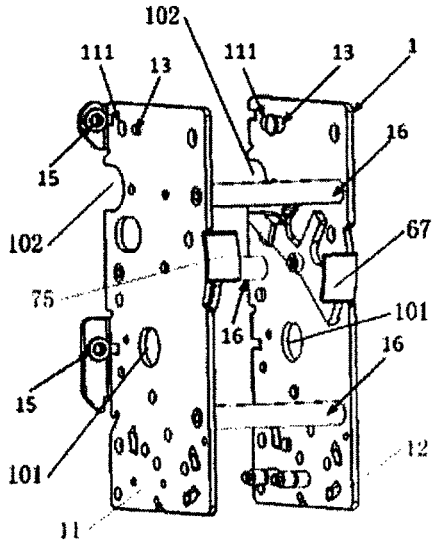
FIG. 3 is a schematic structural drawing of a side plate assembly of the present invention.

The energy storage operation mechanism 99 comprises a side plate assembly 1, a connecting rod assembly 2, a cam assembly 3, an energy storage assembly 4, a rotating shaft assembly 5, a control assembly 6, an interlocking assembly 7 and a handle assembly 8. The connecting rod assembly 2 and the cam assembly 3 in FIG. 1 and FIG. 2 are mounted on a driving shaft 30. One end of the connecting rod assembly 2 is connected with the rotating shaft assembly 5 in a driving manner, and the other end thereof may be connected with the control assembly 6. The rotating shaft assembly 5 may also be coupled to a contact system 96 of the circuit breaker. The end part of the energy storage assembly 4 may be in contact and connection with the cam assembly 3 and the connecting rod assembly 2 respectively. The control assembly 6 may also be connected with the interlocking assembly 7 in a driving manner. An interlocking device formed by the matching of the control assembly 6 and the interlocking assembly 7 can drive the cam assembly 3, the connecting rod assembly 2 and the energy storage assembly 4 to actuate, thereby finishing a switching-on process or a switching-off process of the energy storage operation mechanism 99. In addition, the rotating shaft assembly 5 and the energy storage assembly 4 are mounted to one side of the driving shaft 30. The control assembly 6 and the interlocking assembly 7 are mounted to the other side of the driving shaft 30. The energy storage operation mechanism of the present invention is used in a molded case circuit breaker and may be interchanged with a manual operation mechanism of the molded case circuit breaker, and is connected with the circuit breaker via the side plate assembly 1. The energy storage assembly 4 comprises an energy storage lever 42 and an energy storage spring 48 connected with the energy storage lever 42, wherein one end of the energy storage spring 48 is mounted to one side of the side plate assembly 1, which is connected with the circuit breaker, and the other end of the energy storage spring 48 is connected with one end of the energy storage lever 42. The energy storage lever 42 and the energy storage spring 48 are in an L shape and rotatably arranged at one side of the side plate assembly 1 away from the circuit breaker. The connecting rod assembly 2 and the cam assembly 3 are mounted on the driving shaft 30 and located below the energy storage lever 42. The rotating shaft assembly 5 is arranged between the energy storage spring 48 and the driving shaft 30. One end of the connecting rod assembly 2 is connected with the rotating shaft assembly 5, and the other end thereof is also connected with the control assembly 6 for controlling the switching-on process or the switching-off process. The driving shaft 30 is arranged between the rotating shaft assembly 5 and the control assembly 6. The energy storage operation mechanism of the present invention is used in the molded case circuit breaker and is compact in structure and convenient to assemble and mount, thereby improving the use efficiency. Meanwhile, the energy storage operation mechanism of the present invention is improved in the design layout of the components, which is different from the layout of an energy storage operation mechanism of a universal circuit breaker. An energy storage assembly and a rotating shaft assembly of the existing universal circuit breaker are arranged at two sides of a driving shaft respectively, but because, the energy storage assembly, i.e., the energy storage assembly in the present invention, needs to keep the connecting rod assembly away when the energy storage operation mechanism of the present invention is used in the molded case circuit breaker, the layout of components is redesigned in the present invention, i.e., the energy storage assembly and the rotating shaft assembly are arranged at one side, and the energy storage assembly is arranged at the upper part of the operation mechanism and located above the connecting rod assembly and the cam assembly. Therefore, the action requirements of the assemblies of the energy storage operation mechanism are satisfied, and the operating stability of the energy storage operation mechanism is improved.

Figure 8:
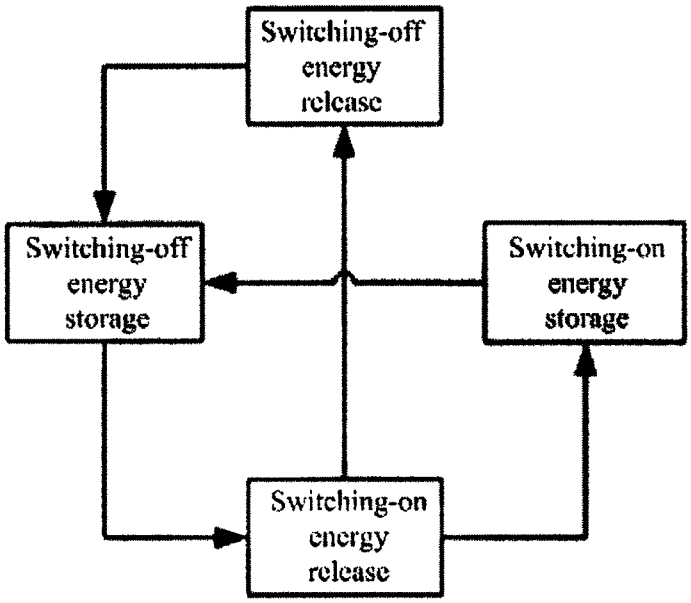
FIG. 8 is a flowchart of a switching-on/switching-off process state according to the present invention.
Figure 9:
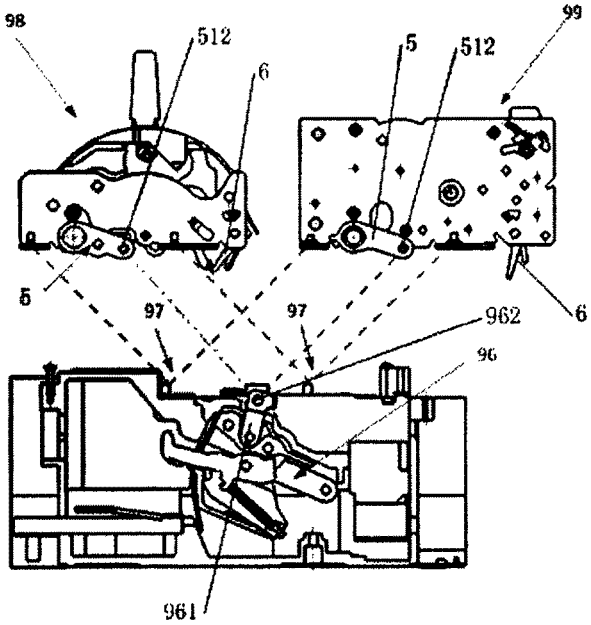
FIG. 9 is a schematic drawing of an interchanged structure according to the present invention.

The energy storage operation mechanism 99 of the present invention has four operating states, i.e., a switching-off energy release state, a switching-off energy storage state, a switching-on energy release state and a switching-on energy storage state as shown in FIG. 8 respectively.

Figure 21:
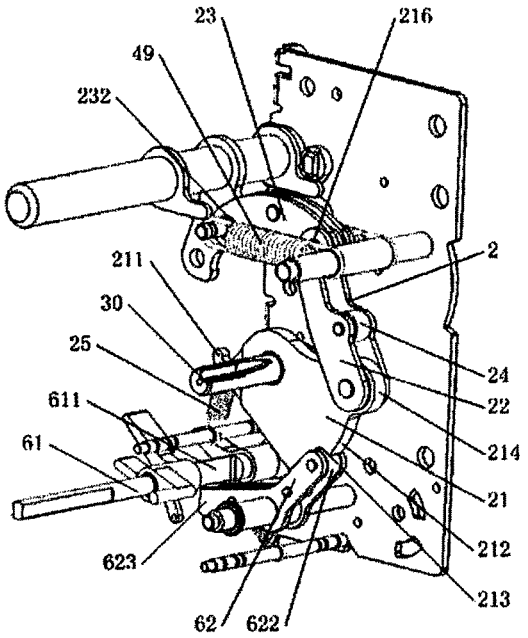
FIG. 21 is a structural state drawing when the connecting rod assembly is in a switching-off energy storage state according to the present invention.

Specifically, when the energy storage operation mechanism 99 is in the switching-off energy release state, the driving shaft 30 is driven by the handle assembly 8 to rotate, thereby driving the cam assembly 3 to rotate; the cam assembly 3 jacks the energy storage lever 42 in a rotating process, such that the energy storage assembly 4 stores energy, and meanwhile, the switching-on latch 64 of the control assembly 6 pushes the cam assembly 3 to further finish energy storage when the cam assembly 3 rotates in place. In addition, the energy storage lever 42 no longer extrudes the connecting rod assembly 2, and the rotating shaft assembly 2 rotates to make a latch bearing 622 at the end part of the switching-off latch 62 slide into a U-shaped groove 213 of the connecting rod assembly 2, such that the energy storage operation mechanism 99 is converted into the switching-off energy storage state as shown in FIG. 21.

Figure 22:
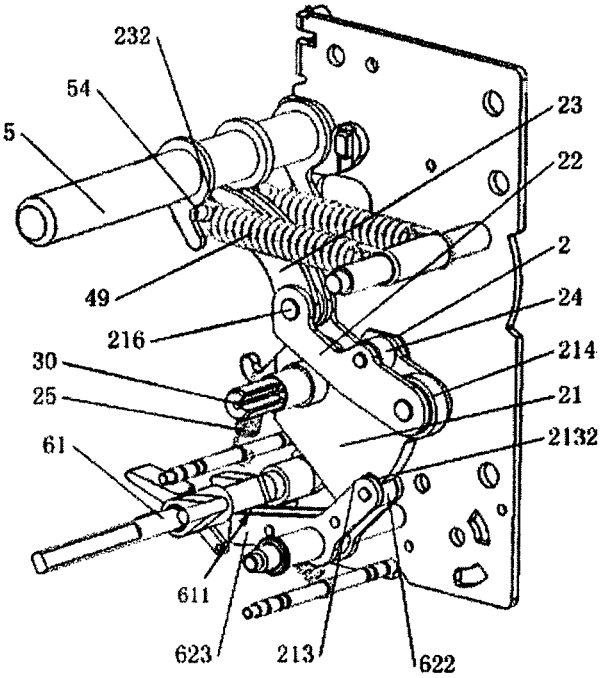
FIG. 22 is a structural state drawing when the connecting rod assembly in a switching-on energy release state according to the present invention.

When the energy storage operation mechanism 99 is in the switching-off energy storage state, a switching-on button 65 is pushed, such that a switching-on guide rod of the interlocking assembly 7 drives the switching-on half-shaft 63 to enable the switching-on latch 64 to be tripped from the cam assembly 3, the energy storage assembly 4 releases energy and hits the connecting rod assembly 2 to pull the rotating shaft assembly 5 to finish the switching-on operation; in addition, the latch bearing 622 pushes the U-shaped groove 213 to stop the connecting rod assembly 2 from rotating and resetting, such that the energy storage operation mechanism 99 is converted into the switching-on energy release state as shown in FIG. 22.

Figure 20:
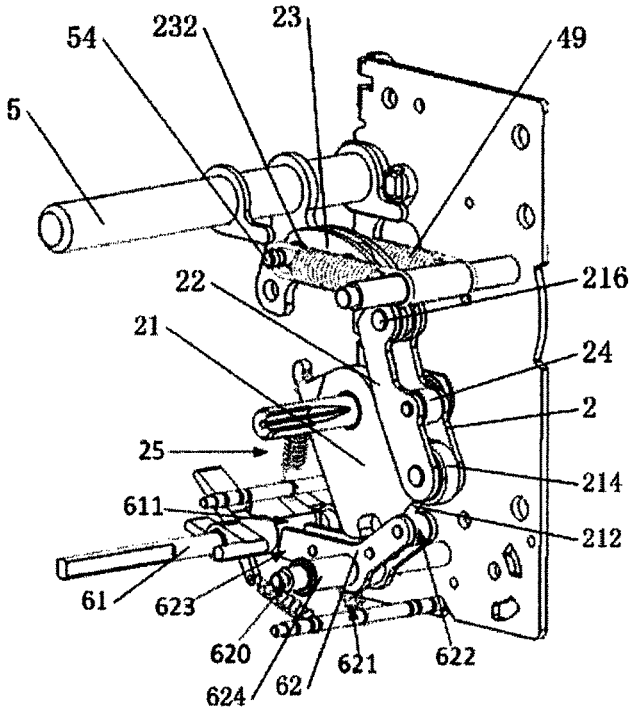
FIG. 20 is a structural state drawing when a connecting rod assembly is in a switching-off energy release state according to the present invention.

When the energy storage operation mechanism 99 is in the switching-on energy release state, the following two operations may be selected. In the first operation, after the switching-off button 66 is pushed, the switching-off half-shaft 61 is driven by the switching-off guide rod 73 to make the latch bearing 622 of the switching-off latch 62 separate from the U-shaped groove 213, and further no longer stop the connecting rod assembly 2 from resetting; the connecting rod assembly 2 drives the rotating shaft assembly 5 to rotate to finish a switching-off operation under a restoring force of main tension springs 49, and the energy storage assembly 4 extrudes the connecting rod assembly 2 again, such that the energy storage operation mechanism 99 at this moment is converted into the switching-off energy release state as shown in FIG. 20.

Figure 27:
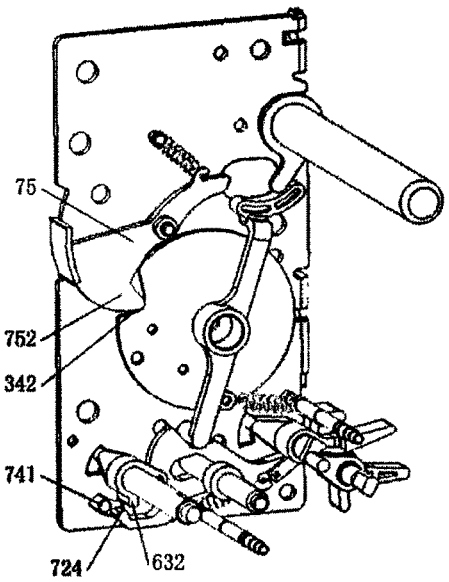
FIG. 27 is a structural state drawing when the interlocking assembly is in a switching-on energy storage state according to the present invention.

In the second operation, when the energy storage operation mechanism 99 is in the switching-on energy release state, the handle assembly 8 is pulled to finish the energy storage to the energy storage assembly 4; the energy storage operation mechanism 99 at this moment is converted to the switching-on energy storage state, wherein the connecting rod assembly 2 is in a state the same as the state in the switching-on energy release in FIG. 22, and the state of the interlocking assembly is as shown in FIG. 27. At this moment, the switching-off button 66 is pushed to finish a switching-off process of the first operation. In addition, because the energy storage lever 42 no longer extrudes the connecting rod assembly 2 after the energy storage assembly 4 stores energy, such that the latch bearing 622 is still placed in the U-shaped groove 213 after the connecting rod assembly 2 drives the rotating shaft assembly 5 to rotate to finish the switching-off operation, and further the energy storage operation mechanism 99 is directly converted into the switching-off energy storage state as shown in FIG. 21. After the switching-on button 65 is pushed again, the switching-on operation can be finished without an energy storage step, and further the use efficiency of the circuit breaker is improved.

The side plate assembly 1 in FIG. 2 comprises a first side plate 11 and a second side plate 12 which face each other. The connecting rod assembly 2, the cam assembly 3, the energy storage assembly 4, the control assembly 6*a* and the interlocking assembly 7 may be mounted in a mounting space formed between the first side plate 11 and the second side plate 12. At lease one side plate fastening shaft 16 for fixedly connecting the first side plate 11 and the second side plate 12 is arranged therebetween in FIG. 3, and preferably, three side plate fastening shafts 16 are arranged between the first side plate 11 and the second side plate, and projections of the three side plate fastening shafts 16 on the first side plate 11 or the second side plate 12 are distributed triangularly. The triangularly distributed side plate fastening shafts ensure corresponding accurate connection between the first side plate and the second side plate, thereby improving the mounting reliability of the operation mechanism for the circuit beaker. Two ends of the driving shaft 30 are correspondingly connected with driving shaft mounting holes 101 formed in the first side plate 11 and the second side plate 12 respectively in a hole-shaft manner. An energy storage indicator 75 and a switching-on/switching-off indicator 67 are rotatably mounted on the first side plate 11 and the second side wall 12 respectively. A first bearing 55 and a second baring 56 are arranged on the rotating shaft assembly 5 in FIG. 2 side by side. The rotating shaft assembly 5 is capable of rotating via the first bearing 55 and the second bearing 56. The first bearing 55 and the second bearing 56 are mounted in rotating shaft mounting notches 102 formed in the first side plate 11 and the second side wall 12 respectively. Each rotating shaft mounting notch 102 is of a U-shaped structure and arranged on the side edge of each of the first side plate 11 and the second side plate 11, which is connected with the molded case circuit breaker. In particular, the rotating shaft assembly 5 and the energy storage assembly 4 are arranged at one side of the mounting space, the control assembly 6 and the interlocking assembly 7 are arranged at the other side of the mounting space, the connecting rod assembly 2 and the cam assembly 3 are mounted in the middle of the mounting space by the driving shaft 30, and the energy storage assembly 4 and the energy storage lever 42 upon which the connecting rod assembly 2 and the cam assembly 3 cooperatively act are located between the connecting rod assembly 2 and the cam assembly 3.

Figure 10:
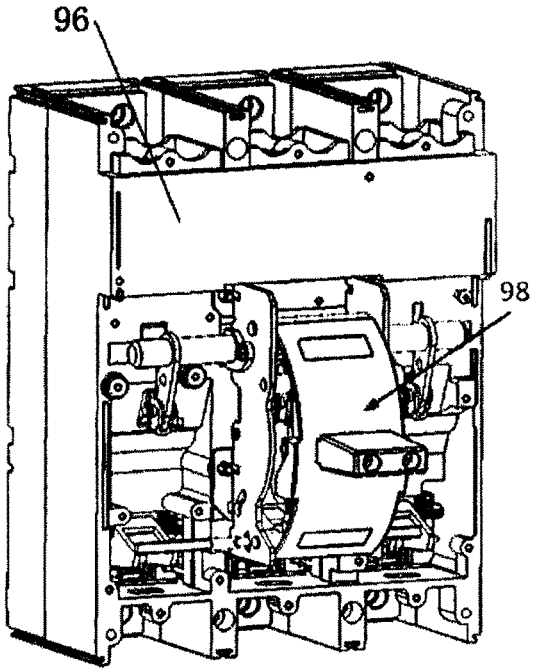
FIG. 10 is a schematic drawing of a mounting structure of a contact system provided with a manual operation mechanism according to the present invention.
Figure 11:
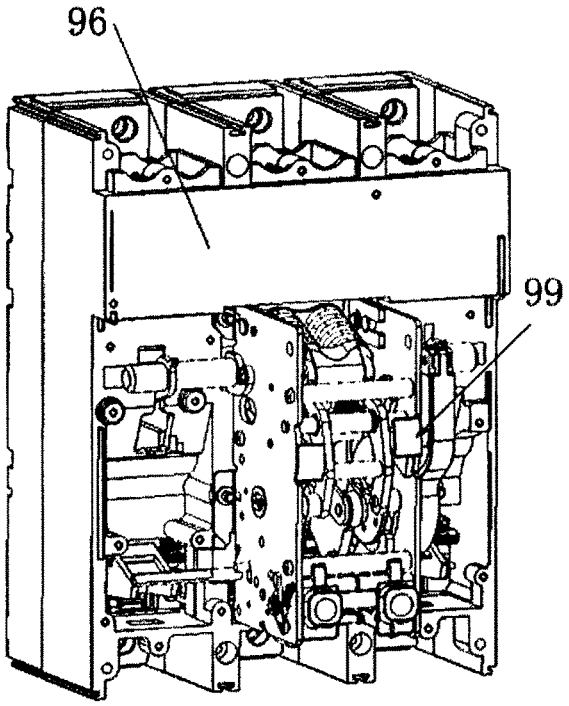
FIG. 11 is a schematic drawing of a mounting structure of a contact system provide with an energy storage operation mechanism according to the present invention.

The operation mechanism for the circuit breaker of the present invention may be an interchanged operation mechanism. The interchanged operation mechanism comprises an energy storage operation mechanism 99 which is connected and mounted on a contact system 96 of a molded case circuit breaker (as shown in FIG. 11), or a manual operation mechanism 98 is connected to the contact system 96 in a driving manner instead of the energy storage operation mechanism 99 (as shown in FIG. 10). The contact system 96 of the molded case circuit breaker is located at one side of the molded case circuit breaker, and a tripping system is located at the other side of the molded case circuit breaker. The rotating shaft assembly 5 and the control assembly 6 on the interchanged operation mechanism in FIG. 9 correspond to the contact system 96 and the tripping system at two sides of the molded case circuit breaker respectively. A coupling connecting rod 961 which can drive a movable contact to act is arranged on the contact system 96, and the rotating shaft assembly 5 may be directly connected with the coupling connecting rod 961 in a driving manner. The control assembly 6 may be connected with the corresponding tripping system in a driving manner. The tripping system may drive the rotating shaft assembly 5 via the control assembly 6 to enable the contact system 96 to be switched off. The rotating shaft assembly 5 is provided with at least one driving mounting hole 512. The coupling connecting rod 961 is provided with a coupling mounting hole 962 which is correspondingly connected to the driving mounting hole 512 in a driving manner via a driving pin, and particularly, the shape of the coupling mounting hole 962 may be a circular hole having an enclosed structure. Furthermore, clamp springs for limiting and mounting are also arranged at two ends of the driving pin. The energy storage operation mechanism 99 comprises the side plate assembly 1. The side surface of the side plate assembly 1 in FIG. 1 is provided with a mechanism mounting hole 15. The side plate assembly 1 may be fixedly connected with the contact system 96 via the mechanism mounting hole 15. The rotating shaft assembly 5 and the control assembly 6 of the energy storage operation mechanism 99 may be connected with the contact system 96 in a coupling manner. The contact system 96 is further provided with a fastening screw 97 which may be correspondingly matched and connected with the mechanism mounting hole 15. The energy storage operation mechanism provided by the present invention may be designed based on the molded case circuit breaker, a thermomagnetic tripping device in a tripper and a magnetic flux tripper of an electronic controller are located at one side of the contact system 96. If the existing energy storage device operation mechanism in which the control assembly 6 and the rotating shaft assembly 5 are mounted on the same side is adopted, the thermomagnetic tripping device is far away from the control assembly 6, which is not advantageous for the switching-on operation or the switching-off operation and affects the operating stability of the circuit breaker. Therefore, in order to realize the interchange between the energy storage operation mechanism 99 and the manual operation mechanism 98 and satisfy the requirement that the two operation mechanisms have the same tripping position and tripping way, the control assembly 6 of the energy storage operation mechanism 99 in the present invention is placed at the lower end, and the energy storage assembly 4 is place at the upper end, and therefore the design requirement is achieved.

Figure 4:
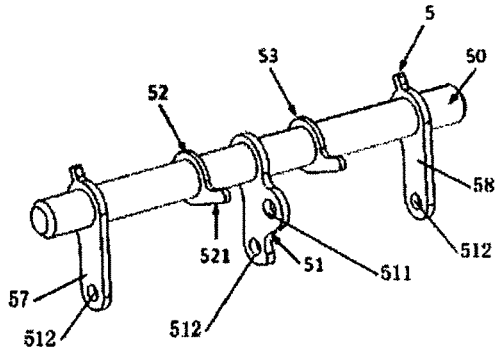
FIG. 4 is a schematic structural drawing of a rotating shaft assembly of the present invention.

The rotating shaft assembly 5 comprises a main shaft 50 mounted on the side plate assembly 1. A first cantilever 51, a second cantilever 52 and a third cantilever 53 are arranged in the middle of the main shaft 50. A fourth cantilever 57 and a fifth cantilever 58 are also arranged at two ends of the main shaft 50 respectively, and a first bearing 55 and a second bearing 56 which are used for connecting the rotating shaft assembly 5 and the side plate assembly 1 and are adjacent to the second cantilever 52 and the third cantilever 53 respectively are arranged on the main shaft 50. The first cantilever 51 in FIG. 4 is provided with a connecting rod mounting hole 511 and a driving mounting hole 512. The connecting rod mounting hole 511 is rotatably connected with the end part of the connecting rod assembly 2 in a hole-shaft manner via a connecting pin 54 in FIG. 2. The driving mounting hole 512 is connected with the contact system 96 of the circuit breaker in a coupling manner. The connecting rod assembly 2 acts to drive the rotating shaft assembly 5 to rotate, thereby driving the contact system 96 to finish a switching-on/switching-off process. The connecting pin ensures the stable connection between the connecting rod assembly and the connecting rod mounting hole. The driving mounting hole 512 is formed in one end of the first cantilever 51, and the other end of the first cantilever 51 is connected to the main shaft 50 of the rotating shaft assembly 5. The connecting rod mounting hole 511 is formed in one side of the middle of the first cantilever 51. The positional relationship of the connecting rod mounting hole and the driving mounting hole ensures the rotating accuracy of the rotating shaft assembly in the switching-on process or the switching-off process, and meanwhile enables the rotation process to be more smooth and stable and improves the operating reliability of the rotating shaft assembly. The first cantilever 52 and the third cantilever 53 on the main shaft 50 are arranged at two sides of the first cantilever 51 respectively. The second cantilever 52 may be matched and connected with an interlocking guide rod 71 of the interlocking assembly 7. The interlocking guide rod 71, the connecting rod assembly 2 and the cam assembly 3 are mounted on the driving shaft 30 simultaneously. The third cantilever 53 may be matched and connected with a switching-on/off indicator 67. Preferably, the fourth cantilever 57 and the fifth cantilever 58 are also arranged at two sides of the main shaft 50. Each of the fourth cantilever 57 and the fifth cantilever 58 are also provided with a driving mounting hole 512 which may be connected with the contact system 96 in a coupling manner. The contact system 96 comprises three groups of single-phase contact systems 96, and the first cantilever 51, the fourth cantilever 57 and the fifth cantilever 58 are connected with the three groups of single-phase contact systems respectively in a driving manner.

Figure 5:
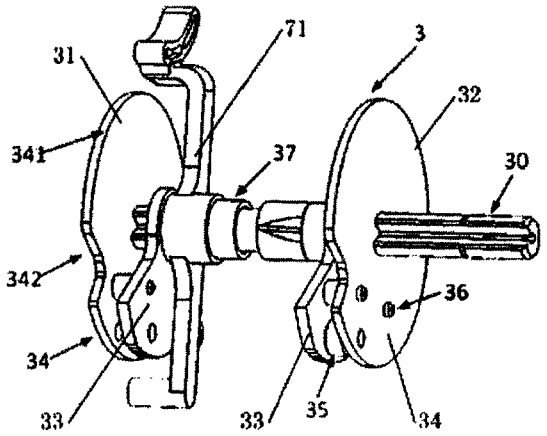
FIG. 5 is a schematic structural drawing of a cam assembly of the present invention.

The cam assembly 3 comprises a first cam group 31 and a second cam group 32 which are coaxially and fixedly mounted on the driving shaft 30. The first cam group 31 and the second cam group 32 are identical in structure and each comprises a disc 34 and a cam 33. The disc 34 and the cam 33 in FIG. 5 are fixedly connected by a cam rivet 36. The edge of the cam 33 may be in contact and connection with the energy storage lever 42 of the energy storage assembly 4. A circular surface 341 of the disc 34 may also be provided with a disc notch 342 which may be in contact and connection with a circular indicator surface 752 of the energy storage indicator 75, and a cam roller 35 which is capable of rotating relatively is clamped between the disc 34 and the cam 33 and may be in contact and connection with the switching-on latch 64 of the control assembly 6. Specifically, the cam 33 pushes the energy storage lever 42 to store energy by extruding an energy storage bearing 43 mounted to the end part of the energy storage lever 42, and then the switching-on latch 64 pushes the cam roller 35 to perform locking, thereby finishing energy storage finally. An interlocking guide rod 71 and the connecting rod assembly 2 which are mounted on the driving shaft 30 are also arrange between the first cam group 31 and the second cam group 32. Two ends of the interlocking guide rod 71 may be correspondingly in contact and connection with the second cantilever 52 of the rotating shaft assembly 5 and the switching-on guide rod 72 of the interlocking assembly 7 respectively. A shaft sleeve 37 is also arranged between the interlocking guide rod 71 and the driving shaft 30. The interlocking guide rod 71 is capable of rotating around the shaft sleeve 37. The interlocking guide hole 71 is also provided with an interlocking guide rod spring hanging hole 715 for mounting an interlocking guide rod resetting spring. The cam assembly is compact in design structure and convenient to mount, and stable in rotation process at the same time. In addition, various components mounted on the driving shaft rotate in a synchronous fit manner, and therefore the efficiency of the switching-on process or the switching-off process is improved.

Figure 6:
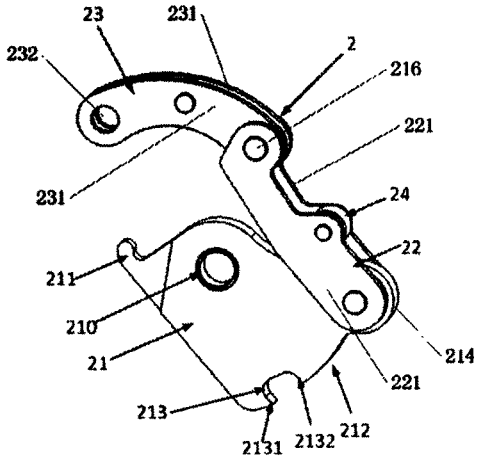
FIG. 6 is a schematic structural drawing of a connecting rod assembly of the present invention.

The connecting rod assembly 2 comprises a second connecting rod 23, a first connecting rod 22 and a jump pin 22 which are connected in sequence, and the second connecting rod 23 and the first connecting rod 22, as well as the first connecting rod 22 and the jump pin 21 are rotatably connected with each other, respectively. The jump pin 21 is kept rotating at one side of the first connecting rod 22 around the end part of the first connecting rod 22. The actions of the jump pin and the first connecting rod are not interfered with each other, so that the action way of the connecting rod assembly is simple and accurate. Two ends of the first connecting rod 22 in FIG. 6 are rotatably connected with the jump pin 21 and the second connecting rod 23 respectively. The jump pin 21 is provided with a jump pin mounting hole 210 which can be connected in a manner of passing through the driving shaft 30. A jump pin hook 21 which may be considered as a driving portion and a jump pin spring 25 for driving the jump pin 21 to rotate relative to the driving shaft are also arranged on the jump pin 21. The end part of the second connecting rod 23 is provided with a connecting rod driving hole 232 which may be connected with the connecting rod mounting hole 511 in a hole-shaft manner via a connecting pin 54. In addition, main tension springs 49 which are used for resetting the position states of the first connecting rod 22 and the second connecting rod 23 are mounted on the connecting pin 54 in FIG. 20. A hitting roller 24 which may be in contact and connection with the hitting pin 44 of the energy storage assembly 4 and may be considered as a trigger portion is mounted on the first connecting rod 22. The driving shaft 30 may drive the cam 33 to rotate and extrude the energy storage assembly 4 to finish energy storage. The energy storage assembly 4 may hit the hitting roller 24 while releasing energy, such that the second connecting rod 23 pulls the rotating shaft assembly 5 to rotate via the connecting pin 54 to finish a switching-on operation. Particularly, the first connecting rod 22 comprises two first connecting rod mounting sheets 221 which are mounted side by side. The hitting roller 24 is clamped between the two first connecting rod mounting sheets 221 and capable of rotating relative to the first connecting mounting sheets 221. The second connecting rod 23 comprises two second connecting rod mounting sheets 231 which are mounted side by side. The end part of each of the two connecting rod mounting sheets 231 is correspondingly provided with a connecting rod driving hole 232, and the corresponding end parts of the two first connecting rod mounting sheets 221 and the two second connecting rod mounting sheets 231 are pivotally connected via a connecting rod connecting pin 216 respectively. The jump pin 21 is provided with a jump pin connecting end 214 which is connected and mounted between the corresponding end parts of the first connecting rod mounting sheets 221. The first connecting rod and the second connecting rod which are formed by way of the mounting sheets are firm in structure and stable in pivotal connection. Furthermore, The edge of the first connecting rod 22, which corresponds to one side of the driving shaft 30, may be in contact and connection with the shaft sleeve 37 on the driving shaft 30.

The jump pin 21 is also provided with a U-shaped groove 213 which is used for limiting and connecting the switching-off latch 62 of the control assembly 6. One side of the jump pin 21, which is provided with the U-shaped groove 213, is also provided with a jump pin connecting end 214 which is rotatably connected with the corresponding end part of the first connecting rod 22. Specifically, a jump pin spring 25 configured to pull and reset is mounted on the jump pin hook 211. One end of the jump pin spring 25 is mounted on the jump pin hook 211, and the other end there of is mounted on the side plate assembly 1. The jump pin is pulled and reset by means of one jump pin spring on the jump pin hook. Compared with the exiting energy operation mechanism in which the jump pin is pulled and reset by two springs at two sides, the jump pin spring mounting structure in the present invention is simple and avoids the rubbing with other components of the connecting rod assembly and the energy storage assembly in the action process at the same time, and further reduces the fault rate of the energy storage operation mechanism and prolongs the service life of the energy storage operation mechanism. In addition, the end part of the switching-off latch 62 is provided with a latch bearing 622 which is matched an connected with the U-shaped groove 231 in a limiting manner. An inside wall of the U-shaped groove 213 comprises an upper U-shaped groove plane 2131 and a lower U-shaped groove plane 2132 which face each other. The jump pin 21 may be driven by the jump pin spring 25 to rotate along the jump pin mounting hole 210 in the process from switching-off energy release to switching-off energy storage, such that the latch bearing 622 at the end part of the switching-off latch 62 slides into the U-shaped groove 213 along a first jump pin contour surface 212 at the side surface of the jump pin 21 to finish limiting connection, and meanwhile, the lower U-shaped groove plane 2131 is in contact and connection with the latch bearing 622 in the switching-off energy storage state. The upper U-shaped groove plane 2132 may be in contact and connection with the latch bearing 622 in the switching-on state. The latch bearing 622 in the switching-off energy release state may be in contact with the first jump pin contour surface 212 at one side, where the U-shaped groove 213 is formed, of the jump pin 21. During energy storage, the jump pin pushes the latch bearing through the U-shaped groove to realize limiting. Compared to most ways in which the energy storage operation mechanism is limited by other fixing shafts, the limiting and latching way of the jump pin in the present invention is simple in structure an stable in latching and effectively improves the action reliability of the jump pin in the switching-on process or the switching-off process.

The jump pin 21 may be of a polygonal structure, and the jump pin hook 211 and the U-shaped groove 213 are arranged at two sides of the jump pin 21 respectively. FIG. 6 illustrates a specific structure embodiment of the jump pin 21. In the present embodiment, the jump pin 21 is of a quadrangular structure, and the jump pin mounting hole 210, the jump pin connecting end 214, the U-shaped groove 213 and the jump pin hook 211 are distributed at four vertexes of the quadrangular jump pin 21 clockwise respectively in sequence. The shape of the jump pin 21 is not limited to the above-described quadrangular structure embodiment but may be a triangular structure, i.e., the jump pin connecting end 214, the U-shaped groove 213 and the jump pin hook 211 are distributed at three vertexes of the triangular jump pin 21 clockwise in sequence, and the jump pin mounting hole 210 is provided in a connecting line between the jump pin connecting end 214 and the jump pin hook 211. The triangular jump pin is simple in structure, and convenient to mount and machine. Meanwhile, the positional layout of the jump pin mounting hole, the jump pin connecting end, the U-shaped groove and the jump pin hook also ensures that the connecting rod assembly operates without interfering with each other.

Figure 7:
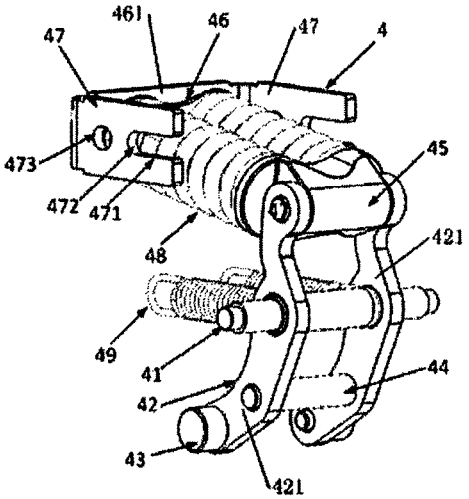
FIG. 7 is a schematic structural drawing of an embodiment of an energy storage assembly of the present invention.

The energy storage assembly 4 comprises an energy storage lever 42, an energy storage spring 48 and a base support 46, wherein one end of the energy storage spring 48 is fixedly mounted on the base support 46, and the other end of the energy storage spring 48 is connected with the energy storage lever 42. One end of the energy storage lever 42 in FIG. 7 is provided with an energy storage end of the energy storage spring 48, and the other end of the energy storage lever 42 is a driving end which may be in contact and connection with the cam assembly 3. A lever fulcrum at which an energy storage mounting shaft 41 may be mounted is also arranged in the middle of the energy storage lever 42, and an external force may be applied to the driving end, such that the energy storage lever 42 rotates around the energy storage mounting shaft 41 to finish energy storage of the energy storage end. The edge of the cam 33 of the cam assembly 3 may be in contact and connection with the energy storage spring 43 mounted at the side surface of the driving end of the energy storage lever 42. The driving shaft 30 can drive the cam 33 to rotate and drive the edge of the cam 33 to push the energy storage bearing 43, such that the energy storage lever 42 rotates around the energy storage mounting shaft 41, thereby compressing the energy storing spring 48 at the energy storage end to finish energy storage. Preferably, the first cam group 31 and the second cam group 32 which are identical in structure are mounted on the driving shaft 30 side by side and may be in contact and connection with energy storage bearings 43 at two sides of the driving end of the energy storage lever 42 respectively. Furthermore, the energy storage lever 42 may also be provided with the hitting pin 44 which corresponds to the hitting roller 24 of the connecting rod assembly 2. The hitting pin 44 is in a circular shape as shown in FIG. 7, or may be a hitting pin 44 having a kidney-shaped section as shown FIG. 30 and FIG. 31. The widths of two ends of the hitting pin 44 having the kidney-shaped section are smaller than the width of the middle part, and therefore, the switching-on stroke and the switching-on efficiency are ensured.

A rotatable driving shaft 30 is arranged at one side of the energy storage lever 42. The connecting rod assembly 2 and the cam assembly 3 are arranged on the driving shaft 30. The cam assembly 3 may be in contact and connection with the driving end of the energy storage lever 42 and pushes the energy storage lever 42, such that the energy storage end stores energy. The connecting rod assembly 2 may be in contact and connection with the energy storage lever 42, and the end part of the connecting rod assembly 2 is connected with the rotating shaft assembly 5 for driving the switching-on operation and the switching-off operation. In the switching-on process, the energy storage lever 42 hits the connecting rod assembly 2, such that the end part thereof pulls the rotating shaft assembly 5 to finish the switching-on operation. In addition, in the switching-on process or the switching-off process, the connecting rod assembly 2 and the cam assembly 3 are kept moving at one side of the energy storage lever 42. The connecting rod assembly and the cam assembly are arranged at one side of the energy storage assembly. The energy storage assembly is located above the connecting rod assembly and the cam assembly, thereby ensuring that the energy storage assembly does not interfere with the connecting rod assembly in the movement process, the energy storage lever is mounted just by one energy storage mounting shaft such that the overall structure is compact, and the reliability of the energy storage assembly is improved. The problems of complicate process and high cost of the prior art in which the energy storage mounting shaft needs to be cut off from the middle to become two short shafts and then the two short shafts are riveted to two sides of the energy storage assembly in order to keep the connecting rod assembly away are avoided. The cam assembly 3 may be driven by the driving shaft 30 to enable the cam 22 to jack the driving end of the energy storage lever 42, such that the energy storage lever 42 rotates to compress the energy storage spring 48 to finish energy storage. In addition, in the energy release process, the movement direction of the riving en of the energy storage lever 42 is opposite to the movement direction of the cam 33. The cam is in stable contact with the energy storage bearing, thereby ensuring the stability of the energy storage process. The movement direction of the cam is opposite to the movement direction of the energy storage lever, such that the energy storage assembly may not cause secondary hit to the cam assembly, and further the cam assembly after the switching-off operation is accurate to position, and the energy loss in the switching-on process is reduced.

Figure 30:
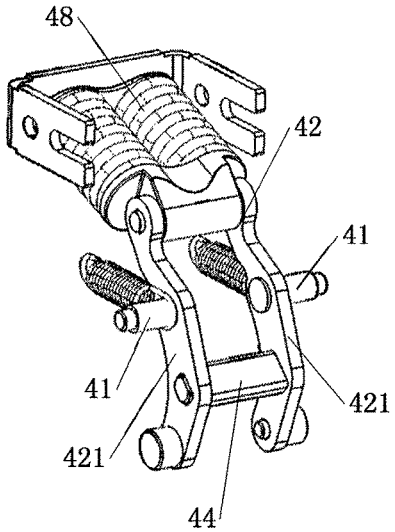
FIG. 30 is a schematic structural drawing of another embodiment of the energy storage assembly according to the present invention.
Figure 31:
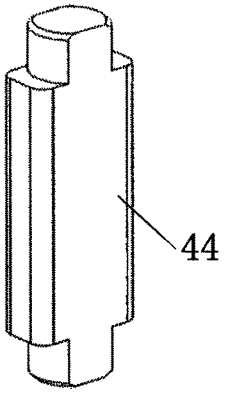
FIG. 31 is a schematic structural drawing of an embodiment of a hitting pin according to the present invention.

The energy storage lever 42 comprises at least two energy storage mounting sheets 421 which are arranged side by side. The energy storage mounting shaft 41 in FIG. 7 penetrates through the energy storage lever 42 and may be rotatably connected with each energy storage mounting sheet 421 in a hole-shaft manner. The energy storage end of the energy storage lever 42 is correspondingly connected with the energy storage mounting sheet 421 which may be connected to a connecting support 45 of the energy storage spring 48. Preferably, the specific example of the energy storage lever of the present invention is as shown in FIG. 7. The energy storage lever 42 comprises two energy storage mounting sheets 421 which are arranged side by side, and one energy storage mounting shaft 41. The energy storage mounting shaft 41 penetrates through the two energy storage mounting sheets 421 respectively, and two ends of the energy storage mounting shaft 41 are fixed on the side plate assembly 1. The connecting rod assembly 2 and the cam assembly 3 are also arranged in the side plate assembly 1. The hitting pin 44 which may be in contact and connection with the hitting roller 24 on the connecting rod assembly 2 is arranged between the two energy storage mounting sheets 421. In addition, the end part of each energy storage mounting sheet 421 is provided with an energy storage bearing 43 which may be in contact and connection with the cam of the cam assembly 3. Compared to the way in which the energy storage lever is connected and mounted from two sides thereof via the two short shafts, the way in which only one energy storage bearing is used has the advantages of high stability and reliability, simple machining process and high assembly efficiency. The energy storage mounting shaft 41 is not limited to the above-mentioned method in which only one energy storage mounting shaft is mounted in a penetrating manner. As shown in FIG. 30, it is also possible to mount the two energy storage mounting sheets 421 on the side plate assembly 1 respectively by two energy storage mounting shafts 41. Particularly, the energy storage lever 42 of the energy storage assembly 4 in FIG. 1 is lower than the edges of the first side plate 11 and the second side plate 12. The energy storage assembly is simple in mounting structure, occupies a few space and facilitates the assembly and use of the operation mechanism. Furthermore, each energy storage mounting sheet 421 is arc-shaped, with two ends thereof being bent towards one side, one side being provided with the energy storage bearing 43 and the other end being connected with the energy storage spring 48 via a spring connecting sheet. The energy storage mounting shaft 41 is arranged in the middle of the energy storage mounting sheet 421. The hitting pin 44 is arranged between the energy storage mounting shaft 41 and the energy storage bearing 43.

The base support 46 in FIG. 7 is of a U-shaped structure and comprises a base support sheet 461 which may be connected with the end part of the energy storage spring 48. Base mounting sheets 47 which face with other are arranged at two sides of the base support sheet 461. Each base mounting sheet 47 is provided with a support guide rail 471 and a support mounting hole 473. The support guide rail 471 is arranged at the end part of the mounting sheet 47. The support mounting hole 473 corresponds to a guide rail terminal 472 of the support guide rail 471, and the support guide rail 471 and the support mounting hole 473 are matched and connected with a guiding shaft 13 mounted on the side plate assembly 1 and a support positioning pin 14 respectively. The first side plate 11 and the second side plate 12 are respectively provided with the guiding shaft 13 and a positioning pin fixing hole 111 for mounting the support positioning pin 14, wherein the guiding shaft 13 may be matched and connected with the support guide rail 471, and the support positioning pin 14 may pass through the positioning pin fixing hole 111 and the support mounting hole 473 at the same time, thereby mounting the base support 46 and the energy storage spring 48 of the energy storage assembly 4 on the side plate assembly 1. In addition, the base mounting sheets 47 at two sides of the base support 46 may be in contact and connection with the first side plate 11 and the second side plate 12 respectively. The base mounting sheets and the side plate assembly are in contact to ensure that the base support does not shake after being mounted, thereby improving the mounting stability of the base support. Preferably, the guide rail terminal 472 may prop against the guiding shaft 13 while the support mounting hole 473 and the support positioning pin 14 are matched and connected. The support positioning pins 14 are mounted in the positioning pin fixing holes 111 formed in the first side plate 11 and the second side plate 12, respectively, and the surface of each support positioning pin 14 is provided with a clamping groove 141. Meanwhile, the energy storage spring 48 obliquely arranged relative to two sides of the base support 46, and is connected to the energy storage end in a manner of inclining from the base supporting sheet 461 to a direction close to the rotating shaft assembly 5. Furthermore, the support mounting hole 472 may be oval. The oval support mounting hole makes the positioning pin have a certain margin during mounting, and further makes the mounting process simple and convenient while ensuring the mounting firmness. Particularly, the energy storage assembly 4 comprises two energy storage springs 48 which are arranged in the base support 46 side by side, a gap is provided between the two energy storage springs 48, and the second connecting rod 23 may be put in the gap in the energy storage process.

When the energy storage assembly 4 is mounted, the energy storage spring 48 is fixedly mounted on the base support 46 having the U-shaped structure first, the support guide rail 471 on the base mounting sheet 47 then props against the guiding shaft 13 of the side plate assembly 1, next, the base support 46 is pushed till the guide rail terminal 472 props against the guiding shaft 13 and does not continue to slide any more, and the positioning pin fixing holes 111 of the side plate assembly 1 at this moment correspond to the centers of the support mounting holes 473, the support positioning pin 14 sequentially passes through the positioning pin fixing hole 111 and the support mounting hole 473 and a retainer ring is clamped in the clamping groove 141 of the support positioning pin 14, and therefore, the mounting of the energy storage assembly 4 is completed. The energy storage assembly is mounted in a simple way, effectively improves the assembly efficiency of the energy storage operation mechanism, facilitates the maintenance and replacement of the energy storage assembly and improves the practicability of the device. Particularly, the base support 46 is mounted to one end of the side plate assembly 1, the base mounting sheets 47 at two sides of the base support 46 are flush with the side edges at one end of the first side plate 11 and at one end of the second side plate 12, and the base supporting sheets 461 are located at one side of the side plate assembly 1, which is connected to the circuit breaker. Furthermore, the energy storage lever 42 is opposite to the base supporting sheet 461 of the base support 46, forms an L shape with the energy storage spring 48, and is arranged at one side of the side plate assembly 1 away from the circuit breaker.

The energy storage operation mechanism 99 further comprises main tension springs 49, wherein one end of each main tension spring 49 is fixedly connected with the energy storage mounting shaft 41, and the other end thereof is fixedly connected with the connecting pin 54 on the rotating shaft assembly 5. Specifically, the first cantilever 51 of the rotating shaft assembly 5 is provided with a connecting rod mounting hole 511, the end part of the second connecting rod 23 of the connecting rod assembly 2 is provided with a connecting rod driving hole 232, the connecting pin 54 may pass through the connecting rod mounting hole 511 and the connecting rod driving hole 232 at the same time to connect and mount the second connecting rod 23 and the first cantilever 51, and two ends of the connecting pin 54 may be provided with the main tension spring 49 respectively. Particularly, the energy storage mechanism 99 comprises two main tension springs 49 which are arrange at two sides of the first cantilever 51 respectively, wherein two ends of each main tension spring 49 are fixedly connected to the end part of the connecting pin 54 and the energy storage mounting shaft 41 respectively. Furthermore, one end of each of the main tension springs 49 is fixed on the rotating shaft assembly 5, and the other end thereof is fixed on the corresponding energy storage mounting shaft 41 between the two energy storage mounting sheets 421. The energy storage mounting shaft 41 comprises a first mounting shaft in the middle and two second mounting shafts at two sides of the first mounting shaft, wherein the diameter of the first mounting shaft is larger than that of each second mounting shaft. The other end of each of the two main tension spring 49 is mounted at the joint between each of the second mounting shafts and the first mounting shaft. The two energy storage mounting sheets 421 are mounted on the second mounting shafts to limit the two main tension springs 49. The mounting position of the main tension springs 49 not only makes the structure compact, while not affecting the rotation of the energy storage lever and facilitating the assembly and mounting of the main tension springs. The fixed mounting position of the main tension springs 49 on the energy storage mounting shaft 41 is not limited to the above-mentioned embodiment, and the main tension springs 49 may be fixedly mounted on the corresponding energy storage mounting shaft 41 between the two energy storage mounting sheets 421 or fixedly mounted on the corresponding energy storage mounting shafts 41 at two sides of the two energy storage mounting sheets 421.

The control assembly 6 comprises a switching-off half-shaft 61, a switching-off latch 62, a switching-on half-shaft 63, a switching-on latch 64, a switching-on button 65 and a switching-off button 66. The interlocking assembly 7 comprises an interlocking guide rod 71, a switching-on guide rod 72, a switching-off guide rod 73, a driving guide rod 74 and an energy storage indicator 75. The switching-on guide rod 72 and the switching-off guide rod 73 are mounted in parallel. The switching-off semi-shaft 61, the switching-off latch 62 and the switching-on half-shaft 63 are mounted between the switching-on guide rod 72 and the switching-off guide rod 73, and the switching-on half-shaft 63 is arranged relatively perpendicular to one end of the switching-on guide rod 72, and the switching-off half-shaft 61 is arranged relatively perpendicular to the other end of the switching-on guide rail 72. The switching-off latch 62 is located between the switching-off half-shaft 61 and the switching-on half-shaft 63. One end of the switching-off latch 62 is connected to the middle part of the switching-off half-shaft 61 in a latching manner.

One end of the switching-on half-shaft 63 is connected with the switching-on latch 64 in a driving manner, and the other end thereof and the driving guide rod 74 face each other. The switching-on guide rod latch 724 at one end of the switching-on guide rod 72 may be provided between the switching-on half-shaft 63 and the driving guide rod 74. At this moment, the switching-on button 65 is pushed to drive the switching-on half-shaft 63 to rotate via the driving guide rod 74 and the switching-on guide rail 72, thereby driving the switching-on latch 64 to be tripped from the cam assembly 3, such that the energy storage assembly 4 releases energy to drive the connecting rod assembly 2 to realize the switching-on operation. When the switching-on guide rod latch 724 is arranged at the side where the switching-on half-shaft 63 and the driving guide rod 74 are located, the switching-off button 65 fails and cannot act on the switching-on half-shaft 63 through the driving guide rod 74. The interlocking guide rod 71 is mounted on the driving shaft 30. One end of the interlocking guide rod 71 may be in contact and connection with the rotating shaft assembly 5 and the energy storage indicator 75, and the other end thereof is in contact and connection with the switching-on guide rod 72. In the switching-off energy storage state, the energy storage indicator 75 makes the interlocking guide rod 71 not limit the switching-on guide rod 72, and the switching-on guide rod 72 resets and rotates under the action of a switching-on guide rod spring, such that the switching-on guide rod latch 724 is provided between the driving guide rod 74 and the switching-on half-shaft 63. Under the other three states, both the rotating shaft assembly 5 and the energy storage indicator 75 can drive the switching-on guide rod 72 to move through the interlocking guide rod 71, such that the switching-on guide rod latch 724 is arranged at the side where the driving guide rod 74 and the switching-on half-shaft 63 are located, and therefore the switching-on button fails.

One end of the switching-off latch 62 is connected with the switching-off half-shaft 61 in a latching manner, and the other end thereof is connected with the connecting rod assembly 2 in a latching manner. One end of the switching-off guide rod 72 is in contact and connection with the end part of the switching-off half-shaft 61, and the other end of the switching-off guide rod 72 is connected with the switching-off button 66 in a driving manner. Under the switching-on state, when the switching-off button 66 is pushed, the switching-off guide rod 73 drives the switching-off half-shaft 61, such that the switching-off latch 62 is tripped from the connecting rod assembly 2, and the rotating shaft assembly is driven by the connecting rod assembly 2 to realize the switching-off operation. Meanwhile, one end of the switching-off half-shaft 61 is in contact and connection with the switching-off guide rod 73, and the other end thereof may be in contact and connection with a switching-on guide rod limiting boss 725 of the switching-on guide rod 72, such that when the switching-off button 66 is pushed or the switching-off half-shaft 61 is directly pushed, the switching-off half-shaft 61 can drive the switching-on guide rod 72 to move, such that the switching-on guide rod latch 724 is arranged at the side where the driving guide rod 74 and the switching-on half-shaft 63 are located, and therefore the switching-on button fails to realize interlocked protection.

Figure 12:
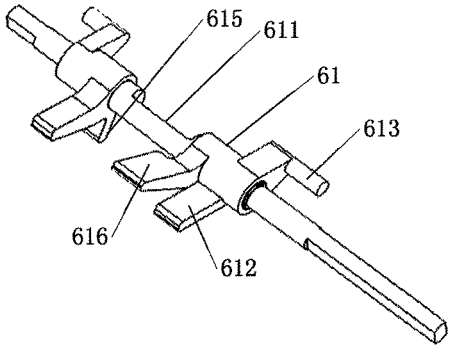
FIG. 12 is a schematic structural drawing of a switching-off half-shaft according to the present invention.
Figure 26:
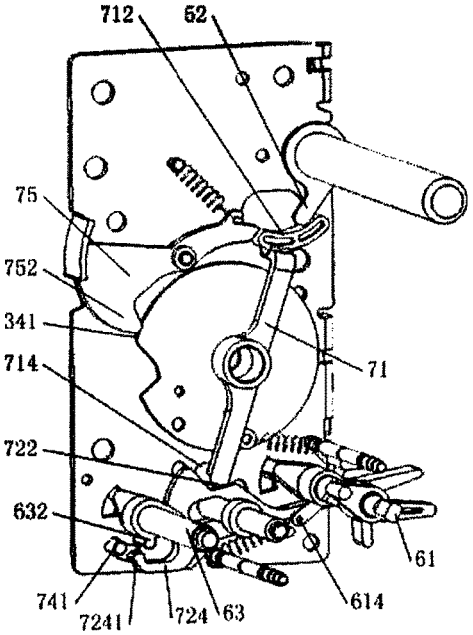
FIG. 26 is a structural state drawing when the interlocking assembly is in a switching-on energy release state according to the present invention.

Specifically, the switching-off half-shaft 61 in FIG. 12 is provided with a semicircular plane 611 matched with the switching-off latch 62. One end of the switching-off half-shaft 61 is provided with a switching-off half-shaft limiting plane 612 matched with the switching-on guide rod 72, a switching-off half-shaft interlocking shaft 613, a switching-off half-shaft spring hanging hole 614 (as shown in FIG. 26) and a switching-off half-shaft driving plane 616 matched with the tripping system of the circuit breaker, and the other end of the switching-off half-shaft 61 is provided with a switching-off plane 615 matched with the switching-off guide rod 73.

Figure 13:
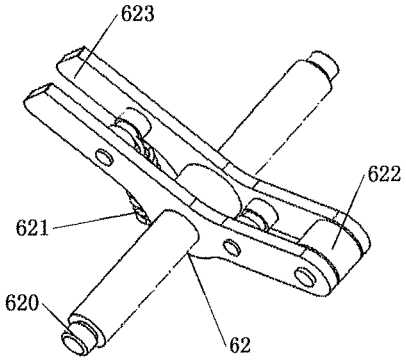
FIG. 13 is a schematic structural drawing of a switching-off latch according to the present invention.

A latch tail end 623 at one end of the switching-off latch 62 in FIG. 13 may be in contact and connection with the switching-off half-shaft 61, and the other end of the switching-off latch 62 is provided with a latch bearing 622 which is connected with the U-shaped groove 213 in a limiting manner. The switching-off latch 62 is mounted on a switching-off latch fixing shaft 620. A positioning sleeve (not shown in drawings) for positioning and mounting the interlocking guide rod 72 is also arranged on the switching-off latch fixing shaft 620, and a latch spring 621 is also hung to one end of the latch tail end 623.

Figure 14:
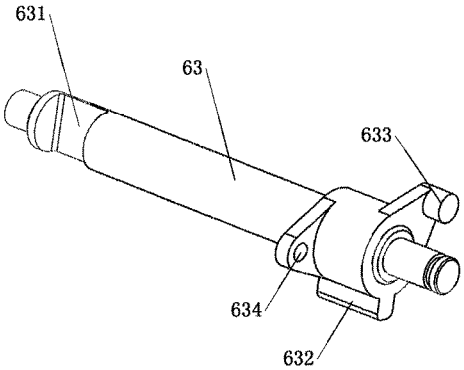
FIG. 14 is a schematic structural drawing of a switching-on half-shaft according to the present invention.

One end of the switching-on half-shaft 63 in FIG. 14 is provided with a semicircular switching-on plane 631, and the other end thereof is provided with a switching-on boss 623, a switching-on limiting shaft 633 and a switching-on half-shaft spring hanging hole 634. The switching-on boss 632 may be connected with the switching-on guide rod 72 and the switching-on latch 64 in a driving manner. The semicircular switching-on plane 631 may be in contact and connection with the end part of the switching-on latch 64. The edge of the switching-on latch 64 may be connected with a cam roller 35 in a latching manner.

Figure 15:
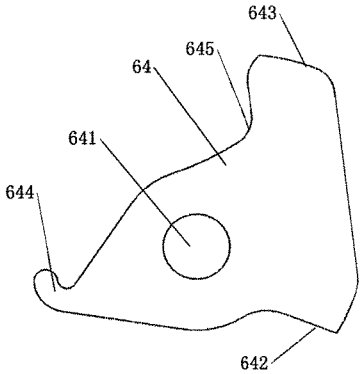
FIG. 15 is a schematic structural drawing of a switching-on latch according to the present invention.

The switching-on latch 64 in FIG. 15 is triangular and provided with a switching-on latch mounting hole 641 in the middle, wherein a switching-on latch driving portion 642 matched with the switching-on half-shaft 63, a switching-on latch energy storage portion 643 matched with the cam roller of the cam assembly 3 and a switching-on latch spring hook 644 for connecting a switching-on latch spring are arranged at three corners of the switching-on latch 64 respectively. A switching-on latch energy storage portion 645 which is matched with the cam assembly 3 is arranged between the switching-on latch energy storage portion 643 and the switching-on latch spring hook 644. In the energy storage process, the switching-on latch energy storage portion 643 of the switching-on latch 64 is in contact and connection with the cam roller 35 of the cam 33 of the cam assembly 3. In the energy release process, the switching-on latch energy release portion 645 of the switching-on latch 64 is kept away from the cam roller 35 of the cam 33 of the cam assembly 3. In the switching-on process, the switching-on half-shaft 63 rotates, such that the semicircular switching-on plane 631 is in contact fit with the switching-on latch driving portion 642 of the switching-on latch 64, and therefore the switching-on latch 64 is tripped from the cam assembly 3 to further trigger the subsequent switching-on action.

Figure 16:
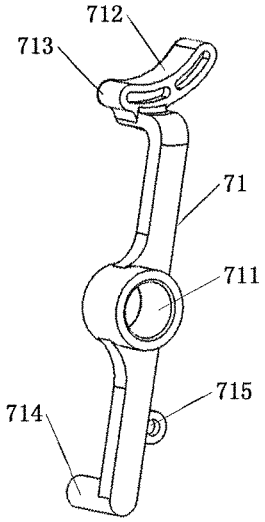
FIG. 16 is a schematic structural drawing of an interlocking guide rod according to the present invention.

An interlocking guide rod positioning hole 711 which is used for mounting the interlocking guide rod 71 to the driving shaft 30 is formed in the middle of the interlocking guide rod 71 in FIG. 16. A shaft sleeve 37 is also arranged between the interlocking guide rod positioning hole 711 of the interlocking guide rod 71 and the driving shaft 30. The interlocking guide rod 71 is capable of rotating around the shaft sleeve 37. The interlocking guide rod is arranged on the driving shaft through the shaft sleeve, without an additional rotating shaft, and therefore the mounting position is reasonable. Two ends of the interlocking guide rod 71 are provided with a limiting portion and a driving portion respectively, wherein the limiting portion is provided with a curved interlocking guide rod surface 712 which is in contact and connection with the energy storage indicator 75 and the rotating assembly 5 respectively. The end part of the curved interlocking guide rod surface 712 is also provided with a circular interlocking guide rod surface 712 which may be in contact and connection with the end part of the energy storage indicator 75. The driving portion is provided with a cylindrical interlocking guide rod surface 714 which may be in contact and connection with the switching-on guide rod 72, and the interlocking guide rod 71 is also provided with an interlocking guide rod spring hanging hole 715 which is used for mounting an interlocking guide rod resetting spring. Particularly, the energy storage indicator 75 and the rotating shaft assembly 5 are arranged at two sides of the limiting position of the interlocking guide rod 71 respectively, and the curved interlocking guide rod surface 712 is arranged in a manner of inclining from the rotating shaft assembly 5 to the energy storage indicator 75.

Figure 17:
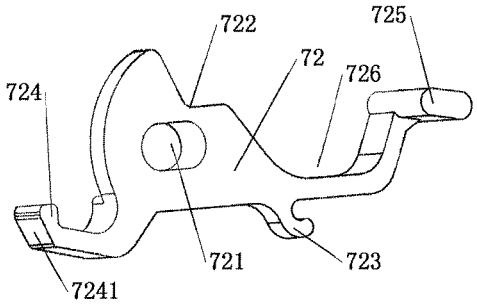
FIG. 17 is a front schematic structural drawing of a switching-on guide rod according to the present invention.

The switching-on guide rod 72 in FIG. 17 is provided with a switching-on guide rod positioning hole 721 which is used for positioning and mounting the switching-on guide rod 72 onto the switching-off latch fixing shaft 620. The switching-on guide rod positioning hole 721 is of an oval structure and is capable of moving relative to the switching-off latch fixing shaft 620. The top of the switching-on guide rod 72 is provided with a switching-on slope 722 which may be in contact and connection with the cylindrical interlocking guide rod surface 714 of the interlocking guider rod 71. The switching-on slope 722 is arranged at the inclined top of the switching-on guide rod positioning hole 721 and located between the switching-on guide rod positioning hole 721 and the switching-on guide rod limiting boss 725. A switching-on guide rod spring hook 723 for mounting the switching-on guide rod spring is arranged at the bottom of the switching-on guide rod 72. The switching-on guide rod spring hook 723 is located between the switching-on guide rod positioning hole 721 and the switching-on guide rod limiting boss 725. One end of the switching-on guide rod 72 is provided with a switching-on guide rod latch 724 which is in contact and connection with the switching-on half-shaft 63 and the driving guide rod 74 respectively. The switching-on guide rod latch 724 is in a shape of an upwards warped hook. A groove for accommodating the switching-on half-shaft 63 is formed between the switching-on guide rod latch 724 and the switching-on guide rod positioning hole 721. An outside wall of the switching-on guide rod latch 724 is provided with a switching-on guide rod latch slope 7241 which is matched and in contact and connection with a driving guide rod protrusion 741 of the driving guide rod 74. The switching-on boss 632 of the switching-on half-shaft 63 corresponds to the driving guide rod protrusion 741 which is arranged at the end part of the driving guide rod 74 in FIG. 19, and the switching-on guide rod latch 724 may be arranged between the switching-on boss 632 and the driving guide rod protrusion 741. The other end of the switching-on guide rod 72 is provided with a switching-on guide rod limiting boss 725 which is in contact and connection with the switching-off half-shaft 61. The section of the switching-on guide rod limiting boss 725 is circular or oval. A switching-on guide rod groove 726 is arranged between the switching-on guide rod limiting boss 725 and the switching-on slope 722. The switching-off half-shaft 61 passes through the switching-on guide rod groove 726.

Figure 18:
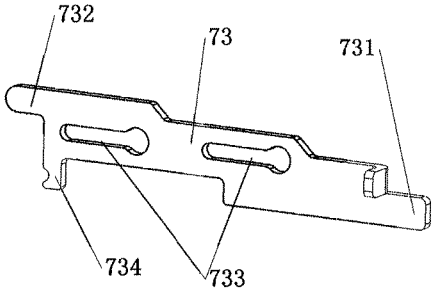
FIG. 18 is a schematic structural drawing of a switching-off guide rod according to the present invention.

One end of the switching-off guide rod 73 in FIG. 18 is a switching-off guide rod trigger end 731 which is in contact and connection with the switching-off button 66, and the other end of the switching-off guide rod 73 is a switching-off guide rod driving end 732 which is in contact and connection with the switching-off plane 615 of the switching-off half-shaft 61. In addition, the switching-off guide rod 73 is also provided with a switching-off guide rod limiting groove 733 configured to guide and limit and a switching-off guide rod spring hook 734 configured to pull and reset.

Figure 19:
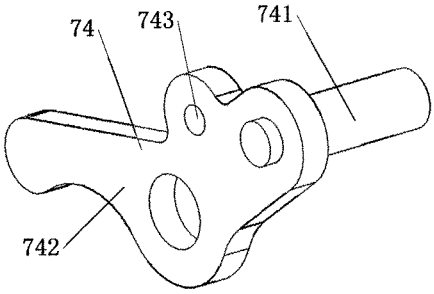
FIG. 19 is a schematic structural drawing of a driving guide rod according to the present invention.

The driving guide rod 74 in FIG. 19 comprises a driving guide rod mounting frame 742. A driving guide rod mounting hole is formed in the middle of the driving guide rod mounting frame 742, and the side edge of the driving guide rod mounting frame 742 is provided with a driving guide rod spring hole 743 which is used for hanging a driving guide rod resetting spring. The side surface of the driving guide rod mounting frame 742 is provided with a driving guide rod protrusion 741 which is matched with the switching-on button 65 and the switching-on guide rod 72.

An indicator positioning hole 751 which is connected with the driving shaft 30 is formed in the middle of the energy storage indicator 75. One end of the energy storage indicator 75 is provided with a circular indicator surface 752 which is in contact and connection and the disc 34, and the other end of the energy storage indicator 75 is provided with an indicator plane 753 which is in contact and connection with the curved interlocking guide rod surface 712. The edge of the energy storage indicator 75 is also provided with an curved indicator surface 754 which is in contact and connection with the circular interlocking guide rod surface 713 at the end part of the curved interlocking guide rod surface 712. In addition, the edge of the energy storage indicator 75 is also provided with an indicator spring hook 755 for mounting an indicator spring.

The specific action states of various assemblies of the energy storage operation mechanism 99 of the present invention in the switching-on process or the switching-off process are as follows: switching-off energy storage, switching-off energy storage, switching-on energy release and switching-on energy storage.

Figure 23:
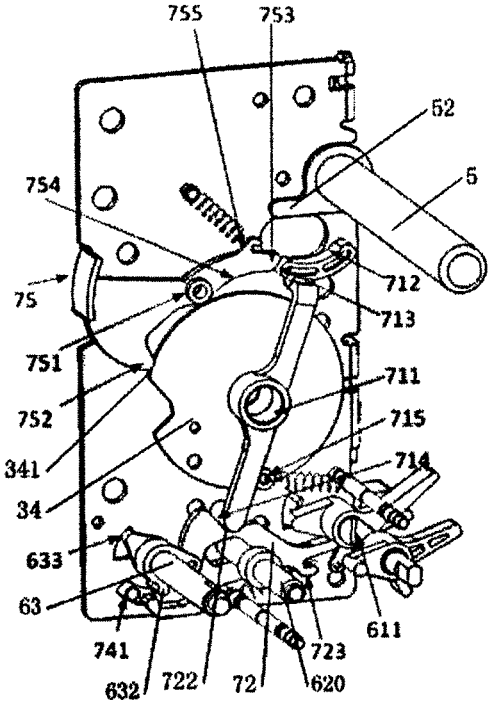
FIG. 23 is a structural state drawing when an interlocking assembly is in a switching-off energy release state according to the present invention.
Figure 29:
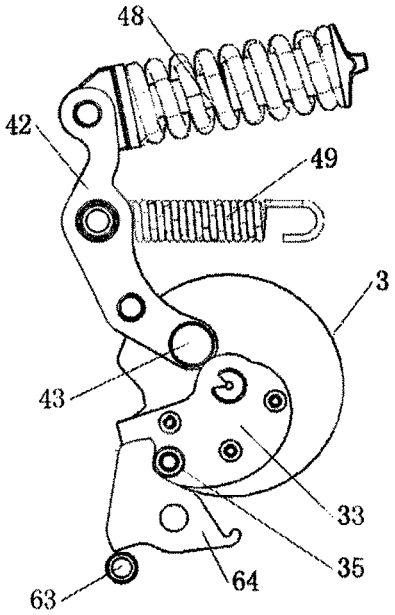
FIG. 29 is a structural side view when the energy storage assembly releases energy according to the present invention.

During the switching-off energy release, when the energy storage operation mechanism 99 is in the switching-off energy release state, there is no elastic extrusion and connection between the cam assembly 3 and the energy storage assembly 4 as shown in FIG. 29, and meanwhile, there is no latching connection between the end part of the switching-on latch 64 and the cam roller 35 of the cam 33. When the control assembly 6 and the interlocking assembly 7 in FIG. 23 are in the switching-off energy release state, the circular interlocking guide rod surface 713 pushes the indicator plane 753 of the energy storage indicator 75, the circular indicator surface 752 pushes a circular surface 341 of the disc 34, the switching-on slope 722 of the switching-on guide rod 72 is pushed by the cylindrical interlocking guide rod surface 714 of the interlocking guide rod 71, and the switching-on guide rod latch 724 at this moment is located at the side where the switching-on boss 632 and the driving guide rod protrusion 741 are located, and is in contact and connection with two of them. When the connecting rod assembly 2 as shown in FIG. 20 is in the switching-off energy release state, the hitting pin 44 on the energy storage assembly 4 extrudes the hitting roller 24, a connecting rod connecting pin 216 is located above the connecting rod driving hole 232 and the jump pin connecting end 214, the latch bearing 622 props against a first jump pin contour surface 212, the jump pin spring 25 is in a tensile energy storage state, and the rotating shaft assembly 5 is located in a switching-off position and the main tension spring 49 is in a contracted energy release state. The switching-off latch 62 of the control assembly 6 enables the latch bearing 622 mounted at one end of the switching-off latch 62 to be in contact and connection with the first jump pin contour surface 212 at one side of the jump pin 2 under the action of the latch spring 621, and meanwhile, a latch tail end 623 at the other end of the switching-off latch 62 props against a semicircular plane 611 in the middle of the switching-off half-shaft 61.

Figure 24:
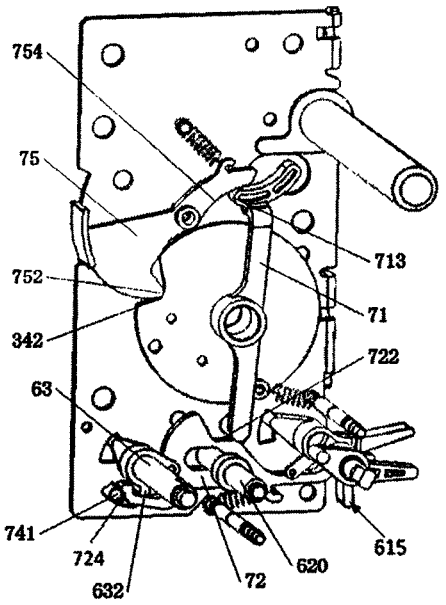
FIG. 24 is a structural state drawing when the interlocking assembly is in a switching-off energy storage state according to the present invention.
Figure 25:
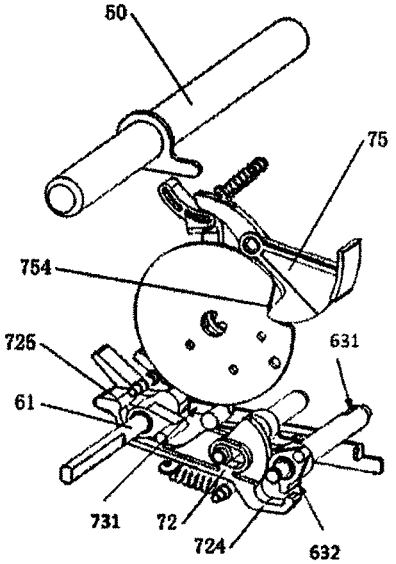
FIG. 25 is another structural state drawing when the interlocking assembly is in a switching-off energy storage state according to the present invention.
Figure 28:
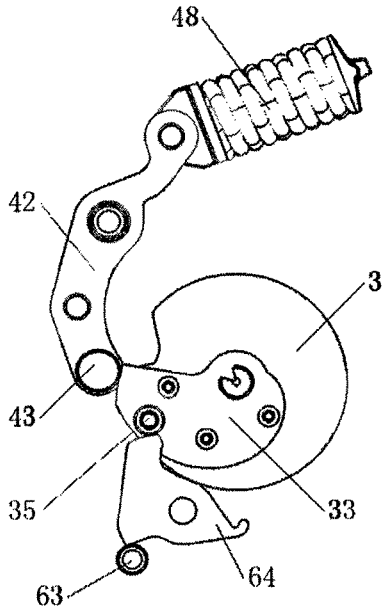
FIG. 28 is a structural side view when the energy storage assembly stores energy according to the present invention.

During the switching-off energy storage, when the control assembly 6 as shown in FIG. 24 and the interlocking assembly 7 are in the switching-off energy state, the circular indicator surface 752 of the energy storage indicator 75 falls into a disc notch 342, the circular interlocking guide rod surface 713 of the interlocking guide rod 71 is in contact and connection with the curved indicator surface 754 of the energy storage indicator 75, and the end part of the interlocking guide rod 71 at this moment swings till the interlocking guide rod 71 does not limit the switching-on guide rod 72 when corresponding to the end part of one side of the switching-on slope 722, and the switching-on guide rod 72 resets and rotates via a switching-on guide rod spring, such that the switching-on guide rod latch 724 of the switching-on guide rod 72 is placed between the switching-on boss 632 and the driving guide rod protrusion 741, thereby finishing the preparation work before the switching-on operation. Particularly, when the energy storage operation mechanism 99 as shown in FIG. 25 is in the switching-off energy storage state, the switching-off button 66 is pushed or the switching-off half-shaft 61 is pushed directly, the switching-on guide rod limiting boss 725 of the switching-on guide rod 72 is pushed by the switching-off half-shaft limiting plane 612 of the switching-off half-shaft 61, such that the switching-on guide rod latch 724 may return to the side where the switching-on boss 632 and the driving guide rod protrusion 741 are located again, and the switching-on button 65 at this moment fails. The cam assembly 3 as shown in FIG. 28 pushes the energy storage bearing 43 in the energy storage assembly 4, such that one end, where the bearing energy bearing 43 is mounted, of the energy storage lever 42 moves upwards and extrudes the energy storage spring 48 at the other end at the same time to store energy, and the end part of the switching-on latch 64 is connected with the cam roller 35 of the cam 33 in a latching manner. When the connecting rod assembly 2 as shown in FIG. 21 is in the switching-off energy storage state, the energy storage assembly 4 finishes energy storage, such that the hitting pin 44 does not extrude the hitting roller 24 again. The jump pin spring 25 releases energy, thereby driving the jump pin 21 to rotate relative to the driving shaft 30. The latch bearing 622 slides along the first jump pin contour surface 212 towards the U-shaped groove 213, till the latch bearing 622 falls into the U-shaped groove 213 and is in contact with a lower U-shaped groove plane 2131, and the connecting rod connecting pin 216 at this moment is still located above the connecting line between the connecting rod driving hole 232 and the jump pin connecting end 214, and the main tension spring 49 is in a contracted energy release state. The jump pin 21 at this moment is limited by the switching-off latch 62, and the latch tail end 623 of the switching-off latch 62 moves to a position below the switching-off half-shaft 61.

During the switching-on energy release, when the energy storage operation mechanism 99 is in the switching-off energy storage state and the switching-off button 66 or the switching-off half-shaft 61 is not pushed, the switching-on button 65 is pushed to drive the driving rod protrusion 741 to be in contact and connection with the switching-on guide rod latch slope 7241 on the switching-on guide rod latch 724 and drive the switching-on guide rod latch 724 to drive the switching-on half-shaft 63 to turn around a tripping position, and further the switching-on latch 64 is tripped from the cam roller 35, the energy storage spring 48 releases energy, and the hitting pin 44 pushes the connecting rod assembly 2 and the rotating shaft assembly 5 to finish the switching-on process. When the control assembly 6 and the interlocking assembly 7 as shown in FIG. 26 is in the switching-on energy release process, the second cantilever 52 presses the curved interlocking guide rod surface 712 of the interlocking guide rod 71, the cylindrical interlocking guide rod surface 714 pushes the switching-on slope 722 of the switching-on guide rod 72, and the switching-on guide rod latch 724 at this moment is located at the side where the switching-on boss 632 and the driving guide rod protrusion 741 are located again and is not in contact and connection with two of them, and the circular indicator surface 752 of the energy storage indicator 75 pushes the circular surface 341 of the disc 34 again. When the connecting rod assembly 2 as shown in FIG. 22 is in the switching-on energy release state, the energy storage assembly 4 releases energy, and the hitting pin 44 hits the hitting roller 24, such that the connecting rod connecting pin 216 is positioned below a connecting line of the connecting rod driving hole 232 and the jump pin connecting end 214, and the upper U-shaped groove plane 2132 is in contact with the latch bearing 622, the connecting rod driving hole 232 pulls the rotating shaft assembly 5 to rotate by the connecting pin 54, and meanwhile, the main tension spring 49 is in a tensile energy storage state, and the rotating shaft assembly 5 drives the contact system 96 to be switched on during rotation.

During the switching-on energy storage, the control assembly 6 as shown in FIG. 27 and the interlocking assembly 7 are in switching-on energy storage state, the circular indicator surface 752 of the energy storage indicator 75 falls into the disc notch 342 again, and other interlocking state is the same as the switching-on energy release state. In addition, the switching-on guide rod latch 724 is positioned at the side where the switching-on boss 632 and the driving guide rod protrusion 741 are located and is not in contact and connection with two of them, and the switching-on button 65 fails.

From the above, the connecting rod assembly 2 and the cam assembly 3 are mounted at one side of the energy storage assembly 4, and therefore, the movement direction of the energy storage assembly 4 is opposite to that of the cam assembly 3 in a switching-on process, and may not cause second hit to the cam assembly 3. After the switching-off operation, the cam assembly 3 is positioned more accurately and stably, and the energy loss of the switching-on process is reduced, the use efficiency is improved, and the structure is compact. However, when the existing energy storage operation mechanism is switched on, the movement direction of the energy storage assembly is the same as that of the cam assembly, and the potential danger of secondary hit will be caused.

In addition, under the condition that the energy storage operation mechanism 99 is in the switching-off energy storage state and the switching-off button 66 or the switching-off half-shaft 61 is not pushed, the switching-on guide rod latch 724 can enter the space between the switching-on boss 632 and the driving guide rod boss 741, and the switching-on button 65 is effective. Under any state, the switching-on guide rod latch 724 is located at the side where the switching-on boss 632 and the driving guide rod protrusion 741 are locate, and the switching-on button 65 fails. The switching-on guide rod latch slope on the switching-on guide rod latch at one end of the switching-on guide rod always presses the switching-on half-shaft in the switching-on process, and therefore the reliability of the switching-on process is improved. The switching-on guide rod limiting boss at the other end of the switching-on guide rod can ensure that the energy storage operation mechanism makes the switching-on button fail under the condition that it is in the switching-off energy storage state or the switching-off button or the switching-off half-shaft is not pushed, and therefore the use safety of the energy storage operation is improved. Meanwhile, the interlocking guide rod realizes up-down linkage of the rotating shaft assembly and the control assembly, such that the energy storage operation mechanism is compact in structure and improves the use efficiency.

The above content is a further detailed description of the present invention in conjunction with specific preferred embodiments, and it should not be considered that the specific implementation of the present invention is limited to these descriptions. Those common skilled in the art may also make some simple deductions or replacements without departing from the concept of the present invention, all of these should be considered to fall into the protection scope of the present invention.

The invention claimed is:

1. A mounting structure for an energy storage assembly of a circuit breaker, comprising an energy storage lever and an energy storage spring, wherein one end of the energy storage lever is an energy storage end which is connected with the energy storage spring, and the other end of the energy storage lever is a driving end;

an external force can be applied to the driving end, such that the energy storage lever rotates around a lever fulcrum in the middle of the energy storage lever, thereby extruding the energy storage spring at the energy storage end to finish energy storage;

one end of the energy storage spring is connected and mounted with the energy storage lever, and the other end of the energy storage spring is mounted in a U-shaped base support comprising a base supporting sheet which can be connected with the other end part of the energy storage spring, and base mounting sheets oppositely arranged at two sides of the base supporting sheet;

a support guide rail configured to guide and limit is also arranged on each base mounting sheet, a guide shaft matched with the support guide rail is fixedly mounted on a side plate assembly;

an energy storage mounting shaft which can be considered as a rotating fulcrum is also arranged in the middle of the energy storage lever;

the driving end is stressed, such that the energy storage lever rotates around the energy storage mounting shaft.

2. The mounting structure for the energy storage assembly of the circuit breaker according to claim 1, wherein the side surface of the base support can be connected and mounted with the side plate assembly configured to fix, thereby fixing the energy storage spring inside the base support;

each base mounting sheet is provided with a support mounting hole which can be matched and connected with the side plate assembly through a support positioning pin.

3. The mounting structure for the energy storage assembly of the circuit breaker according to claim 1, wherein the end part of each base mounting sheet is provided with the support guide rail;

during mounting, when the guiding shaft on the side plate assembly is in contact with a guide rail terminal, a support hole and a positioning pin fixing hole in the side plate assembly are aligned, and connected and mounted via the support positioning pin.

4. The mounting structure for the energy storage assembly of the circuit breaker according to claim 2, wherein the side plate assembly comprises a first side plate and a second side plate;

the energy storage assembly of the circuit breaker is mounted between a first side plate and a second side plate;

the base mounting sheets at two sides of the base support can be in contact and connection with the first side plate and the second side plate respectively, and the base supporting sheet of the base support is located at one side of the side plate assembly, which is connected to the circuit breaker, and is mounted to one end of the side plate assembly;

the base mounting sheets at two sides of the base support are flush with the side edge at one end of the first side plate and the side edge at one end of the second side plate.

5. The mounting structure for the energy storage assembly of the circuit breaker according to claim 1, wherein the energy storage lever comprises at least two energy storage mounting sheets which are arranged side by side;

the energy storage mounting shaft penetrates through the energy storage lever and can be rotatably connected with each energy storage mounting sheet in a hole-shaft manner.

6. The mounting structure for the energy storage assembly of the circuit breaker according to claim 5, wherein a rotatable driving shaft is arranged at one side of the energy storage lever;

a connecting rod assembly and a cam assembly are mounted on the driving shaft;

the cam assembly can be in contact and connection with a driving end of the energy storage lever, such that the energy storage assembly stores energy;

the connecting rod assembly can be in contact and connection with the energy storage lever and can also be connected with a rotating shaft assembly for driving a switching-on/switching-off operation;

in a switching-on process, the energy storage assembly releases energy, and the energy storage lever hits the connecting rod assembly to enable the end part thereof to pull the rotating shaft, thereby finishing the switching-on operation; and in the switching-on/switching-off process, the connecting rod assembly and the cam assembly are kept to move at one side of the energy storage lever.

7. The mounting structure for the energy storage assembly of the circuit breaker according to claim 6, wherein the cam assembly can be driven by the driving shaft to enable a cam to jack a driving end of the energy storage lever, such that the energy storage lever rotates to compress the energy storage spring to finish energy storage; and in an energy release process, a movement direction of the driving end of the energy storage lever is opposite to that of the cam.

8. The mounting structure for the energy storage assembly of the circuit breaker according to claim 5, wherein the energy storage assembly is mounted on the side plate assembly;

the side plate assembly comprises the first side plate and the second side plate which face each other;

two ends of the energy storage mounting shaft are fixedly mounted on the first side plate and the second side plate respectively;

one end of the energy storage spring is mounted at one side of the side plate assembly, which is connected with the circuit breaker, through the base support;

the energy storage lever and the base support face each other;

the energy storage lever and the energy storage spring are of an L shape and arranged at one side of the side plate assembly away from the circuit breaker;

two ends of the rotating shaft assembly and two ends of the driving shaft are mounted on the first side plate and the second side plate respectively;

the connecting rod assembly and the cam assembly are mounted on the driving shaft and located below the energy storage lever;

the rotating shaft assembly is arranged between the energy storage spring and the driving shaft;

one end of the connecting rod assembly is connected with the rotating shaft assembly, and the other end of the connecting rod assembly is also connected with the control assembly for controlling the switching-on/switching-off operation;

the driving shaft is arranged between the rotating shaft assembly and the control assembly.

9. The mounting structure for the energy storage assembly of the circuit breaker according to claim 8, wherein the energy storage lever is lower than the edges of the first side plate and the second side plate.

10. The mounting structure for the energy storage assembly of the circuit breaker according to claim 8, wherein main tension springs for driving the rotating shaft assembly to reset are arranged between the rotating shaft assembly and the energy storage mounting shaft.

11. The mounting structure for the energy storage assembly of the circuit breaker according to claim 5, wherein the energy storage lever comprises two energy storage mounting sheets which are arranged side by side, and one energy storage mounting shaft, wherein the energy storage mounting shaft penetrates through the two energy storage mounting sheets respectively, and two ends of the energy storage mounting shaft are fixed on the side plate assembly;

the connecting rod assembly and the cam assembly are also arranged in the side plate assembly;

a hitting pin which can be in contact and connection with the connecting rod assembly is arranged between the two energy storage mounting sheets;

an energy storage bearing which can be in contact and connection with the cam of the cam assembly is also arranged at the end part of each energy storage mounting sheet.

12. The mounting structure for the energy storage assembly of the circuit breaker according to claim 11, wherein each energy storage mounting sheet is arc-shaped, and two ends thereof are bent towards one side respectively, with one end being provided with the energy storage bearing and the other end being connected with the energy storage spring via a spring connecting sheet;

the energy storage mounting shaft is arranged in the middle of the energy storage mounting sheet, the hitting pin is arranged between the energy storage mounting shaft and the energy storage bearing, and the section of the hitting pin is kidney-shaped.

13. The mounting structure for the energy storage assembly of the circuit breaker according to claim 2, wherein the support mounting hole is of an oval structure; the surface of the support positioning pin is provided with a clamping groove and passes through the positioning pin fixing hole and the support mounting hole in sequence, and a retainer ring is clamped into the clamping groove.

* * * * *